US008621920B2

(12) United States Patent
Reid et al.

(10) Patent No.: US 8,621,920 B2
(45) Date of Patent: Jan. 7, 2014

(54) OBTAINING AND EVALUATING DOWNHOLE SAMPLES WITH A CORING TOOL

(75) Inventors: Lennox Reid, Houston, TX (US); Anthony R. H. Goodwin, Sugar Land, TX (US); Peter S. Hegeman, Stafford, TX (US); Charles Woodburn, Clamart (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 412 days.

(21) Appl. No.: 12/782,398

(22) Filed: May 18, 2010

(65) Prior Publication Data

US 2010/0223989 A1 Sep. 9, 2010

Related U.S. Application Data

(62) Division of application No. 11/852,390, filed on Sep. 10, 2007, now Pat. No. 7,748,265.

(60) Provisional application No. 60/845,332, filed on Sep. 18, 2006.

(51) Int. Cl.
*E21B 49/00* (2006.01)

(52) U.S. Cl.
USPC ..... 73/152.11

(58) Field of Classification Search
USPC ..... 73/152.11–152.17; 702/6, 7, 11
See application file for complete search history.

(56) References Cited

U.S. PATENT DOCUMENTS

| | | | | | |
|---|---|---|---|---|---|
| 2,599,405 | A | | 6/1952 | Mennecier | 175/40 |
| 3,018,660 | A | | 1/1962 | Schmid | 73/152.09 |
| 3,025,465 | A | * | 3/1962 | Breen | 324/689 |
| 4,356,872 | A | | 11/1982 | Hyland | 175/58 |
| 4,371,045 | A | | 2/1983 | McGuire et al. | 175/17 |
| 4,449,594 | A | | 5/1984 | Sparks | 175/59 |
| 4,714,119 | A | | 12/1987 | Hebert et al. | 175/20 |
| 4,860,581 | A | | 8/1989 | Zimmerman et al. | 73/152.26 |
| 4,868,751 | A | | 9/1989 | Dogru et al. | 702/12 |
| 4,886,118 | A | * | 12/1989 | Van Meurs et al. | 166/245 |
| 4,920,792 | A | | 5/1990 | DiFoggio | 73/152.07 |
| 4,936,139 | A | | 6/1990 | Zimmerman et al. | 73/152.26 |
| 4,996,489 | A | * | 2/1991 | Sinclair | 324/639 |
| 5,209,309 | A | | 5/1993 | Wilson | 175/58 |
| 5,232,049 | A | | 8/1993 | Christiansen et al. | 166/268 |
| 5,301,759 | A | | 4/1994 | Ruhle | 175/58 |

(Continued)

FOREIGN PATENT DOCUMENTS

WO 2007007048 1/2007

OTHER PUBLICATIONS

Bilek, J. et al., Thermal Conductivity of Molten Lead-Free Solders, Int'l J. of Thermophysics, v. 27, pp. 92-102, Jan. 2006.

*Primary Examiner* — Leonard Chang
*Assistant Examiner* — Tamiko Bellamy
(74) *Attorney, Agent, or Firm* — Cathy Hewitt; John Vereb

(57) ABSTRACT

Samples of hydrocarbon are obtained with a coring tool. An analysis of some thermal or electrical properties of the core samples may be performed downhole. The core samples may also be preserved in containers sealed and/or refrigerated prior to being brought uphole for analysis. The hydrocarbon trapped in the pore space of the core samples may be extracted from the core samples downhole. The extracted hydrocarbon may be preserved in chambers and/or analyzed downhole.

17 Claims, 12 Drawing Sheets

(56) References Cited

U.S. PATENT DOCUMENTS

| | | | | |
|---|---|---|---|---|
| 5,314,615 | A | 5/1994 | Campos et al. | 208/370 |
| 5,411,106 | A * | 5/1995 | Maissa et al. | 175/78 |
| 5,439,065 | A | 8/1995 | Georgi | 175/59 |
| 5,487,433 | A | 1/1996 | Mackay et al. | 175/78 |
| 5,622,231 | A | 4/1997 | Thompson | 175/77 |
| 5,803,186 | A | 9/1998 | Berger et al. | 175/50 |
| 5,811,973 | A | 9/1998 | Meyer, Jr. | 24/338 |
| 6,157,893 | A | 12/2000 | Berger et al. | 702/9 |
| 6,755,246 | B2 | 6/2004 | Chen et al. | 166/250.01 |
| 7,500,388 | B2 | 3/2009 | Fujisawa et al. | 73/152.11 |
| 2001/0050559 | A1 * | 12/2001 | Wisler et al. | 324/377 |
| 2004/0140126 | A1 | 7/2004 | Hill et al. | 175/20 |
| 2006/0102343 | A1 | 5/2006 | Skinner et al. | 166/250 |
| 2007/0137894 | A1 | 6/2007 | Fujisawa et al. | 175/20 |
| 2008/0066536 | A1 | 3/2008 | Goodwin et al. | 73/152.24 |

* cited by examiner

OBTAINING AND EVALUATING DOWNHOLE SAMPLES WITH A CORING TOOL

CROSS-REFERENCE TO RELATED APPLICATIONS

This application is a division of U.S. patent application Ser. No. 11/852,390, filed Sep. 10, 2007, which is a non-provisional application of co-pending U.S. Provisional Patent Application 60/845,332, filed Sep. 18, 2006, the entire contents of both being hereby incorporated herein by reference.

BACKGROUND

1. Field of the Invention

This invention relates broadly to evaluating hydrocarbon trapped in the pores of an underground formation. More particularly, this invention relates to obtaining and evaluating hydrocarbon samples with a coring tool.

2. State of the Art

"Heavy oil" or "extra heavy oil" are terms of art used to describe very viscous crude oil as compared to "light crude oil". Large quantities of heavy oil can be found in the Americas, in particular, Canada, Venezuela, and California. Historically, heavy oil was less desirable than light oil. The viscosity of the heavy oil makes production very difficult. Heavy oil also contains contaminants and/or many compounds which make refinement more complicated. Recently, advanced production techniques and the rising price of light crude oil have made production and refining of heavy oil economically feasible.

Heavy oil actually encompasses a wide variety of very viscous crude oils. Medium heavy oil generally has a density of 903 to 906 $kg \cdot m^{-3}$, an API (American Petroleum Institute) gravity of 25° to 18°, and a viscosity of 10 to 100 mPa·s. It is a mobile fluid at reservoir conditions and may be extracted using for example cold heavy oil production with sand (CHOPS). Extra heavy oil generally has a density of 933 to 1,021 $kg \cdot m^{-3}$, an API gravity of 20° to 7°, and a viscosity of 100 to 10,000 mPa·s. It is a fluid that can be mobilized at reservoir conditions and may be extracted using heat injection techniques, such as cyclic steam stimulation, steam floods, and steam assisted gravity drainage (SAGD) or solvent injection techniques such as vapor assisted extraction (VAPEX). Tar sands, bitumen, and oil shale generally have a density of 985 to 1,021 $kg \cdot m^{-3}$, an API gravity of 12° to 7°, and a viscosity in excess of 10,000 mPa·s. They are not mobile fluids where the formation temperature is approximately 10° C. (in Canada), and must be extracted by mining. Hydrocarbons with similar densities and API gravities, but with viscosities less than 10,000 mPa·s can be partially mobile where the formation temperature is approximately 50° C. (in Venezuela).

From this discussion, it becomes apparent that production techniques may vary significantly depending, amongst other things, on the density or API gravity of the oil, and its viscosity. Thus, knowledge of the composition or the physical properties of heavy oils would provide valuable insight as to the viability of various production strategies that might be utilized to extract heavy oil and/or bitumen from the formation. Therefore, it would be desirable to obtain a sample of the formation oil, with or without solid suspension (mostly sand) and preferably without drilling fluid, in order to gain this knowledge. If a sample is available, it may be analyzed uphole or downhole and a production strategy may be derived from the results of this analysis.

In the past, sampling tools, such as described in U.S. Pat. Nos. 4,860,581 and 4,936,139 have been proposed for taking samples of formation fluid. In the case of light oil, formation fluids are sampled by delivering a tool downhole and simply extracting formation fluid by applying a pressure differential to the formation wall. However, heavy oil may not easily be sampled in this way, as explained in further details below.

Indeed, the efficiency of fluid sampling as performed with conventional sampling tools depends usually on the rate of fluid flow from formation rock. More specifically, the flow rate Q of fluid from formation rock is given by Equation 1 where $\Delta p$ is the pressure difference applied by the sampling tool, k is the permeability of the formation, and $\eta$ is the fluid viscosity.

$$Q \propto \Delta p \cdot k / \eta \quad (1)$$

As seen from Equation 1, the flow rate can be increased by increasing the pressure difference or the permeability or by decreasing the viscosity. The magnitude of the pressure difference is limited by the sampling tool (a maximum of approximately 50 MPa) and the consolidation of the formation, i.e. how large a pressure difference can be maintained before the formation collapses. In addition, other than fracturing and/or acidizing the formation, there is not much that can be done to increase the permeability. A possible method of sampling heavy oil would be to increase the hydrocarbon mobility by injecting a solvent. However, this might be unpractical when the solvent can not diffuse in the oil.

Furthermore, even if a representative sample were obtained downhole, bringing it uphole could cause an unknown change in the physical characteristics of the sample. Because of the environment in which heavy oil and bitumen are found, samples taken downhole can change when brought to the surface for analysis. Such changes include the evaporation of potentially volatile components such as methane, ethane, and propane; the precipitation of waxes or asphaltenes; the contamination by wellbore fluids; etc.

From the foregoing it will be appreciated that there are many challenges to obtaining and analyzing representative formation hydrocarbon samples when these hydrocarbons have a very low mobility.

SUMMARY

It is therefore an object of this disclosure to provide tools and methods for evaluating a reservoir, and particularly, although not exclusively, reservoir containing hydrocarbon having a very low mobility. Hydrocarbon samples of the reservoir are obtained with a coring tool.

In accordance with one aspect of the disclosure, a method for evaluating an underground formation includes conveying a coring tool to the formation, receiving a core sample in the tool, extracting at least a portion of the hydrocarbon from the core sample in the tool, and analyzing at least a portion of the extracted hydrocarbon.

In accordance with another aspect of the disclosure, a method for evaluating an underground formation includes conveying a coring tool to the formation, obtaining a core sample from the formation, placing at least a portion of the core sample into a processing chamber, at least partially flooding the core sample, extracting fluid from the core sample, and analyzing at least a portion of the core.

In accordance with another aspect of the disclosure, a method for evaluating an underground formation includes delivering a coring tool to the formation, obtaining a core sample from the formation, and receiving the sample in the tool. A dielectric constant of the sample may be measured at a plurality of frequencies. Alternatively a thermal diffusivity of the sample or a heat capacity of the sample may be measured.

In accordance with another aspect of the disclosure, a method of preserving hydrocarbon samples obtained from an underground formation includes delivering a coring tool to the formation, obtaining a core sample from the formation, the core sample including a hydrocarbon therein, capturing the core sample in a container, sealing the container downhole with the hydrocarbon contained therein, and storing the sealed container in the tool.

In accordance with another aspect of the disclosure, a method of preserving hydrocarbon samples obtained from an underground formation includes delivering a coring tool to the formation, obtaining a core sample from the formation, receiving the sample in the tool, cooling the core sample in the tool, and retrieving the tool with the cooled core sample to the surface.

Additional objects and advantages of the invention will become apparent to those skilled in the art upon reference to the detailed description taken in conjunction with the provided figures.

DETAILED DESCRIPTION

Figure 1:
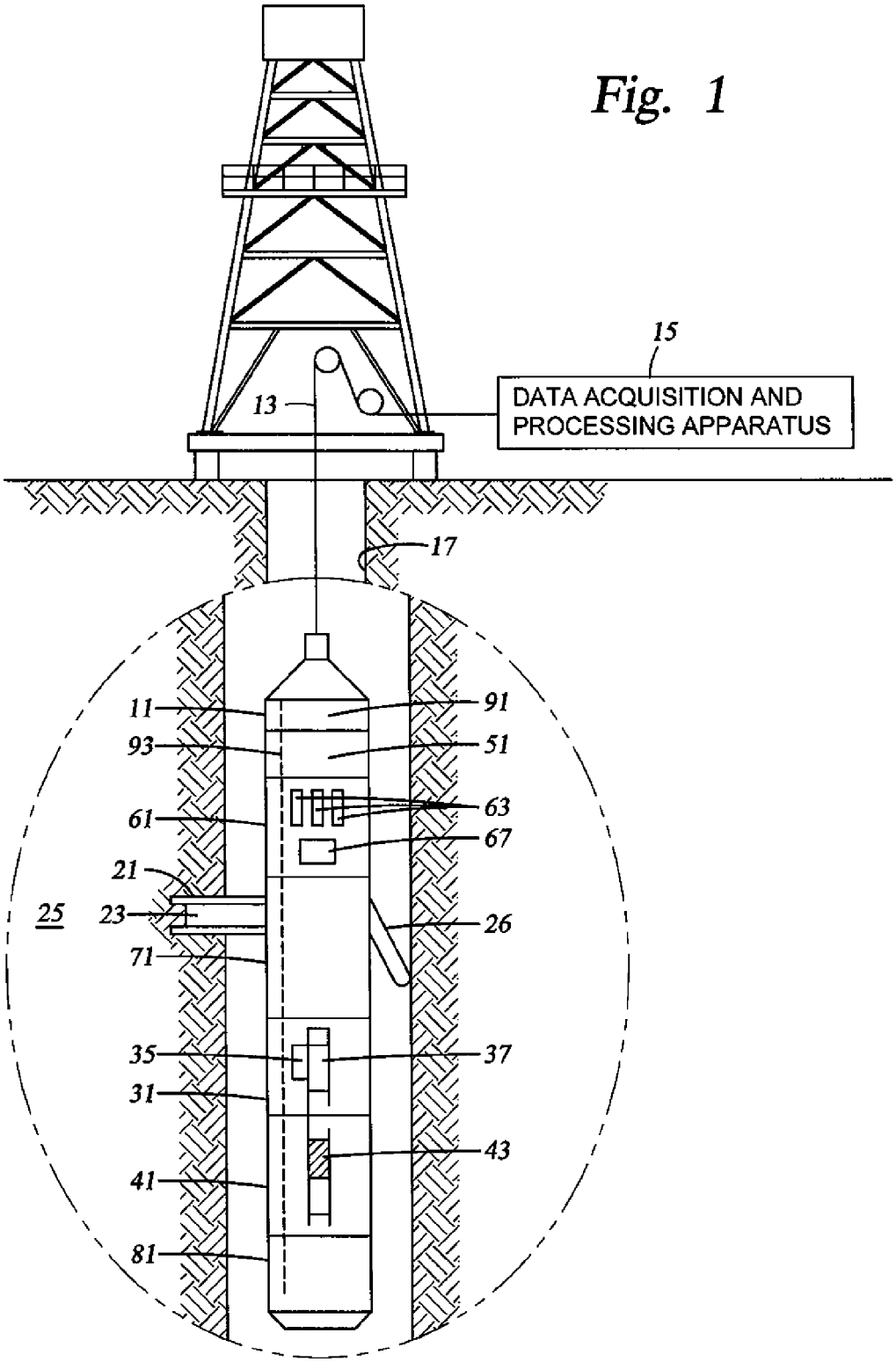
FIG. 1 is a schematic illustration of a downhole tool according to the disclosure lowered by a wireline into a wellbore.

An exemplary version of the tools according to this disclosure is illustrated in FIG. 1. The tool string 11 may be used for capturing a core 23 at the location of interest 25. The core usually contains at least some pristine formation hydrocarbon trapped in the pores of the rock/formation. This is particularly true if the hydrocarbon has a very low mobility. Therefore, the tool string 11 is capable of obtaining a sample representative of the formation hydrocarbon. Ideally, the core provides an aliquot of the formation hydrocarbon having a composition which well represents the important characteristics of the reservoir. The tool string 11 is further capable of analyzing this aliquot downhole or preserving it for a surface analysis as further detailed below. The tool string 11 is further capable of analyzing some of the properties of the core that are pertinent to the mobilization of the hydrocarbon in the reservoir in which the core has been formed.

For the sake of clarity, only a few details are illustrated in FIG. 1. In wireline well logging, one or more tools containing sensors for taking geophysical measurements are connected to a wireline 13, which is a power and data transmission cable that connects the tools to a data acquisition and processing apparatus 15 on the surface. The tools connected to the wireline 13 are lowered into a wellbore 17 to obtain hydrocarbon samples from the area surrounding the wellbore. The wireline 13 supports the tools by supplying power to the tool string 11. Furthermore, the wireline 13 provides a communication medium to send signals to the tools and to receive data from the tools.

The tools 31, 41, 51, 61, 71, and 81 are typically connected via a tool bus 93 to a telemetry unit 91 which in turn is connected to the wireline 13 for receiving and transmitting data and control signals between the tools and the surface data acquisition and processing apparatus 15.

Commonly, the tools are lowered in the wellbore and are then retrieved by means of the wireline 13. While in the wellbore 17, the tools collect and send data via the wireline 13 about the geological formation through which the tools pass, to the data acquisition and processing apparatus 15 at the surface, usually contained inside a logging truck or a logging unit (not shown).

The wireline tool string 11, as implemented in one embodiment, contains a control section 51, a fluid storage section 61, a side-wall coring tool 71, a core analysis section 31, a core storage section 41, and a storage cooling section 81.

The side-wall coring tool 71 is operable to acquire multiple side-wall core samples during a single trip into the wellbore. When the side-wall coring tool 71 is lowered into a wellbore 17 to a depth of interest 25, the coring bit 21 acquires a side-wall core 23 from the wellbore 17. One or more brace arm 26 is used to stabilize the coring tool 71 in the wellbore 17 when the coring bit 21 is functioning. The side-wall coring tool 71 may convey the core 23 to the core analysis section 31, or to the core storage section 41.

The core analysis section 31 comprises in one embodiment at least one sensor 35 for performing tests on the core sample 23. The sensor 35 is connected via the tool bus 93 to the telemetry unit 91 for transmission of data to the data acquisition and processing apparatus 15 at the surface via the wireline 13. In another embodiment, the core analysis section comprises a core processing chamber 37 for extracting formation fluid from the core sample, and optionally for performing tests on the extracted fluid. Extraction might require the use of a solvent, or the use of heat. Extraction might also require the use of a grinder.

The extracted fluid may be conveyed into a fluid storage chamber 63 disposed in the fluid storage section 61. The fluid storage section may comprise a fluid transfer means 67, such as a bidirectional pump, for circulating fluid between the fluid storage section 61 and the core analysis section 31. Additionally, downhole sensors (not shown) provided in conjunction with the fluid storage section 61 could be used to analyze extracted hydrocarbons and to determine physical properties such as density, viscosity, and phase borders as well as chemical composition. For example, these downhole sensors may provide spectroscopic measurements, as is well known in the art.

The core storage section 41 is capable of storing a plurality of cores. In one embodiment, each core is individually sealed from wellbore fluids in an individual container 43. Individual containers may be used to advantage for obtaining at the surface a fluid captured within the core 23 that is representative of the reservoir fluid.

In one embodiment, the core storage section 41 is maintained at a desirable temperature by the core cooling section 81. Cooling may again be used to advantage for obtaining at the surface a fluid captured within the core 23 that is representative of the reservoir fluid.

The control section 51 controls some operations of the tools 61, 71, 31, 41 or 81, either from commands received from the data acquisition and processing apparatus 15, or from a surface operator (not shown). Alternatively, the control section 51 may control some operations of the tools 61, 71, 31, 41 or 81 utilizing closed-loop algorithms implemented with a code executed by a controller (not shown) disposed in the control section 51. Thus, a signal generated by one or more downhole sensors may be analyzed, and one or more downhole actuators may be piloted based on the signal.

Although FIG. 1 schematically depicts a wireline tool, it will be appreciated from the following discussion of the different embodiments, the tools or the methods according to the invention are not limited to wireline deployment, but may be deployed in any other conventional manner such as via coiled tubing, drill pipe, etc. In addition, although FIG. 1 depicts a side wall coring tool, the tools or the methods according to the invention are not limited to side wall coring tools, but may be implemented in any other coring tools known to those skilled in the art, such as in-line coring tool for example.

According to one aspect of this disclosure, the tool 11 extracts downhole an aliquot of hydrocarbon for chemical analysis, as further detailed with respect to FIGS. 2A, 2B, 3A, 3B and 3C. In one exemplary application, the tool 11 is utilized in a reservoir containing bitumen or heavy oil. Bitumen and heavy oil usually contain significant quantities of asphaltenes which constitute the highest molar mass of the hydrocarbon material. Asphaltenes comprise polar molecules and are soluble in aromatic solvents but not in alkane solvents. Asphaltenes are also "self-associating" and form aggregates which increase hydrocarbon viscosity. Thus, knowledge of the chemical structure and molar fraction of asphaltenes in a formation hydrocarbon material would provide valuable insight as to the viability of various production strategies that might be utilized to extract heavy oil and/or bitumen from the formation.

Figure 2A:
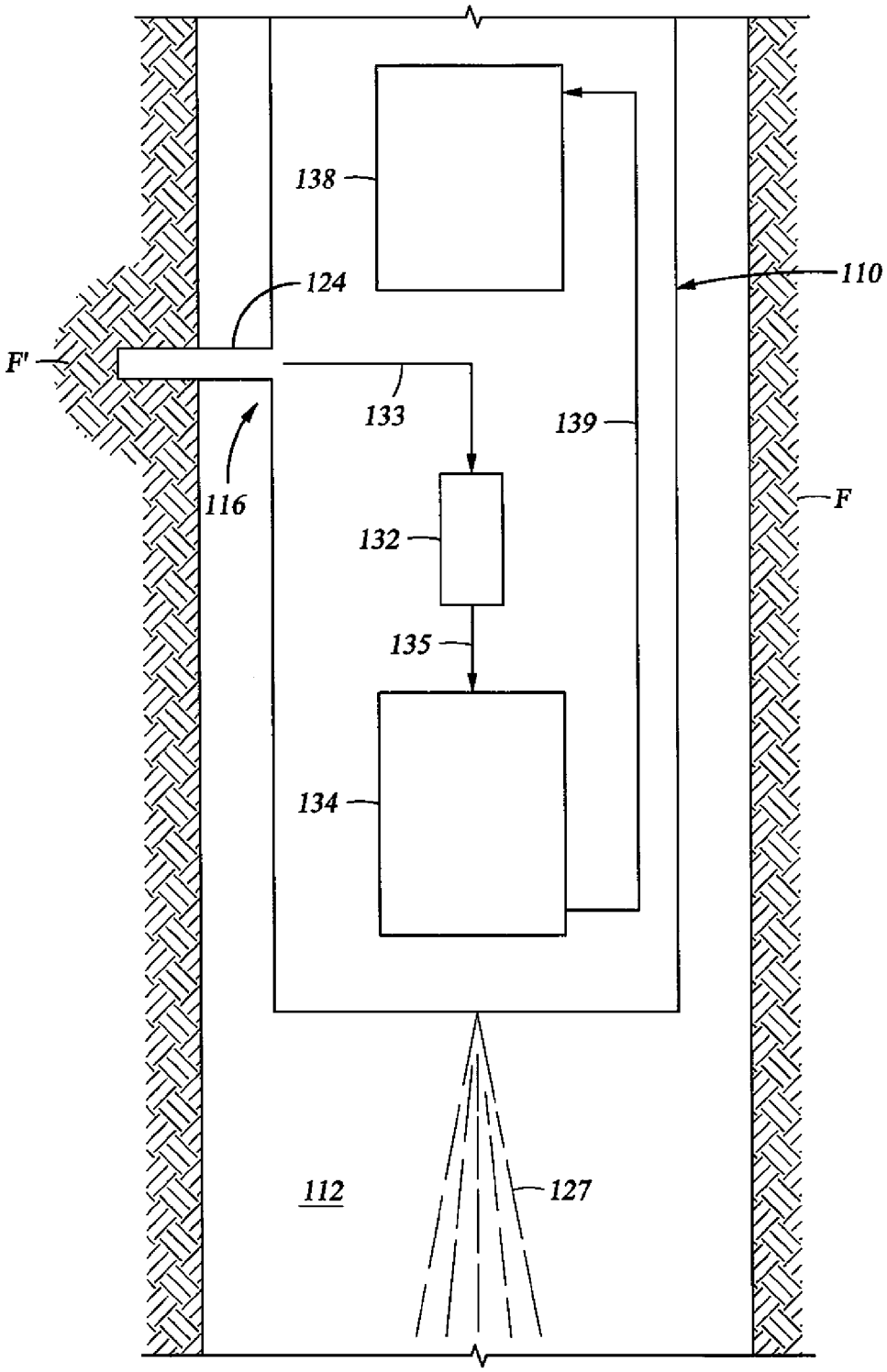
FIG. 2A is a high level schematic diagram of a downhole tool according to the disclosure, wherein cores may be ground.

Referring now to FIG. 2A, a downhole tool 110 is shown schematically deployed in a wellbore 112 of a formation F containing for example heavy oil or bitumen. The apparatus is provided with a coring tool 116, similar to the coring tool 71 of FIG. 1. The coring tool 116 includes a coring bit 124, similar to the coring bit 21 of FIG. 1, to obtain core samples from locations about F'. The cores 132 are retracted into the tool as shown schematically by the arrow 133. As shown schematically by the arrow 135, the cores are placed in a processing chamber 134, similar to the processing chamber 37 of FIG. 1. According to this embodiment, the core is processed to separate formation rock from reservoir fluid. The rock may be analyzed, e.g. by spectrometry, for characterizing at least partially its elemental composition. As an example, the existence of some trace elements may be useful for determining what geologic processes formed the rock, e.g. volcanic, sedimentation, etc. After the reservoir fluid is separated from the rock, and the rock may be ejected from the chamber 134 as shown schematically by 127, or may be stored into the tool as further detailed below. The extracted reservoir fluid is delivered to a sample retrieval chamber 138, similar to the fluid storage chamber 63 of FIG. 1, via a flowline 139.

Figure 2B:
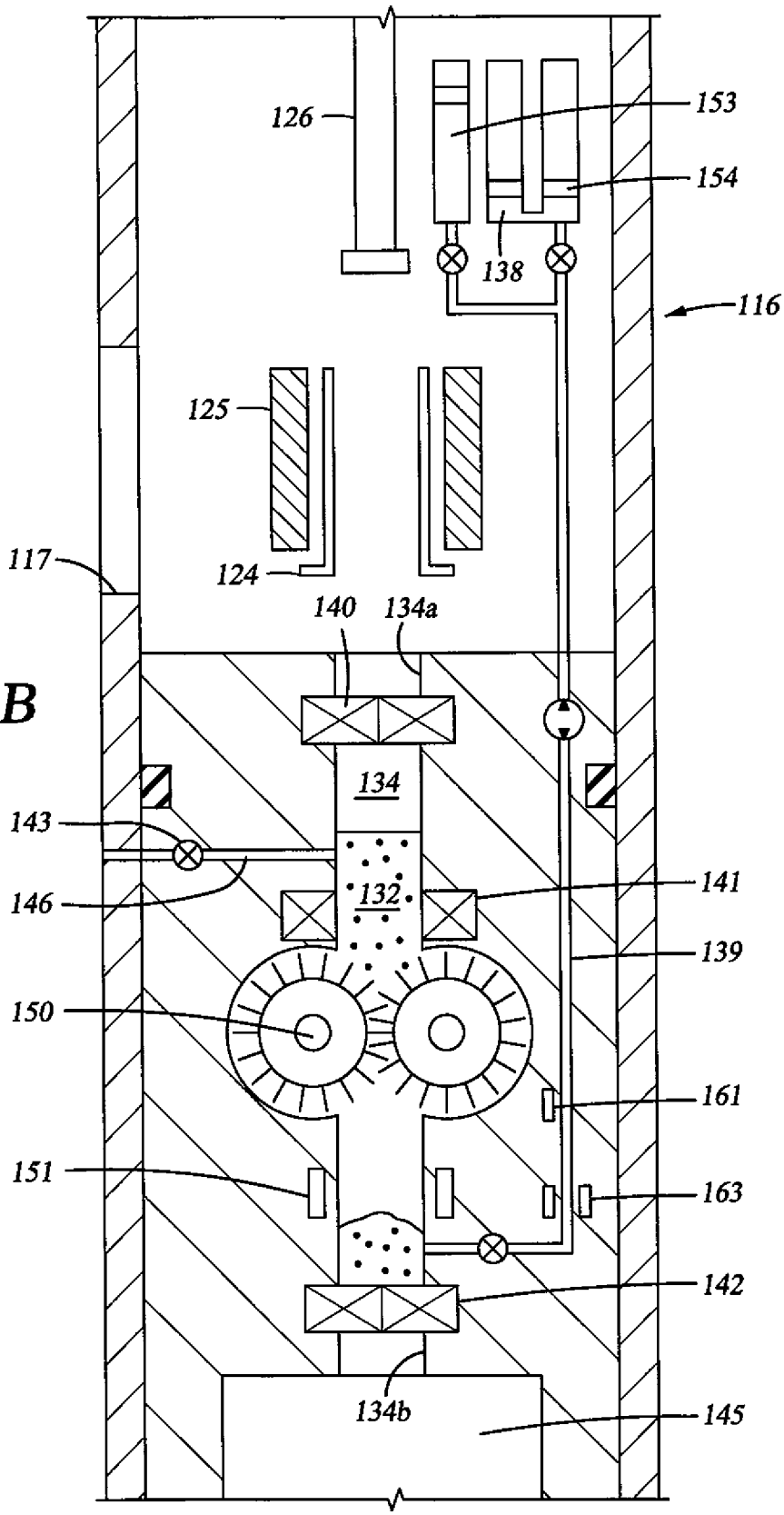
FIG. 2B is a detailed diagram of the downhole tool of FIG. 2A.

FIG. 2B shows a portion of the coring apparatus 116 of FIG. 2A in more details. The coring apparatus 116 comprises a coring assembly 125 disposed next to an aperture 117 in the housing of the coring tool 116. The coring assembly 125 can be pivoted into a coring position (as shown in FIG. 2A). The coring assembly 125 includes a coring bit 124 that can be rotated within and extended from the coring assembly 125 and into the formation wall. The coring assembly is used to cut and sever a core, as known in the art.

As shown in FIG. 2B, the core 132 may further be captured by the tool. The coring bit 124 and the core are retracted into the coring assembly 125. The coring assembly 125 is pivoted into the core ejection position. A core pusher 126 may slide through the coring assembly 125 and through the coring bit 124 for ejecting the core, for example into the processing chamber 134. The processing chamber 134 receives the core 132 through an inlet 134*a*. The core 132 may transit (with means not shown) within the processing chamber 134 to an outlet 134*b* of the processing chamber 134, and may be disposed for example into a dump chamber 145. The dump chamber may be filled with air or other convenient buffer fluid.

In the embodiment of FIG. 2B, the processing chamber comprises valves 140, 141 and 142, disposed along the processing chamber. The valves provide a fluid lock between the wellbore 112 (FIG. 2A) and the dump chamber 145. As the core is captured within the drill bit 124, the core is usually surrounded by wellbore fluid. Before the core is ejected into the processing chamber, the valve 141 is closed and the valve 140 is open. As the core is introduced into the processing chamber 134, the wellbore fluid may be evacuated from the processing chamber through the flow line 146, disposed between the processing chamber and the wellbore. The valves 140 and 143 are then closed, isolating thereby the core from the wellbore fluid. Thus, the processing chamber may be sealed from the wellbore fluid. The valve 141 may then be opened, allowing the core 132 to slide into the processing chamber.

The fluid trapped in the core 132 may be separated from the core. The core may be ground into pieces with a grinder or mill 150, disposed in the processing chamber 134. The methods of separating the reservoir fluid from the formation rock may include mobility enhancement techniques. These techniques include delivering heat to the ground core, for example using a heater 151. The heater 151 may be a resistive heater, a radio or micro-wave source directed at the sample, an ultrasonic source, or a chemical reactor. Alternatively or additionally, the mobility enhancement techniques include delivering a solvent, such as a polar liquid, to the ground core. In this example, additional tool components such as solvent storage containers 153 and membranes 154 to separate reservoir fluid solute from solvent may be required. The semi-permeable membrane 154 solely permits passage of the solvent. Other separation methods could be used so long as they do not subject the formation substance sample to conditions that could result in degradation. For example, the separation of solute from solvent may be accomplished by distillation at ambient or below ambient pressure.

The fluid that has been separated from the ground core may be analyzed with a viscosity sensor 161, or with a spectrometer 163, disposed along the flowline 139. The fluid may be discarded in the wellbore (not shown) or stored in the chamber 138 for later analysis in an uphole facility. Alternatively, the hydrocarbon in the core cuttings may be analyzed before the fluid is separated from the ground core.

According to an alternative embodiment of reservoir sample collection and grinding, a drill and auger (Archimedes screw) fitted with a collection hopper may be used. Samples collected with this apparatus consist of a mixture of hydrocarbon and crumbled rock.

Figure 3A:
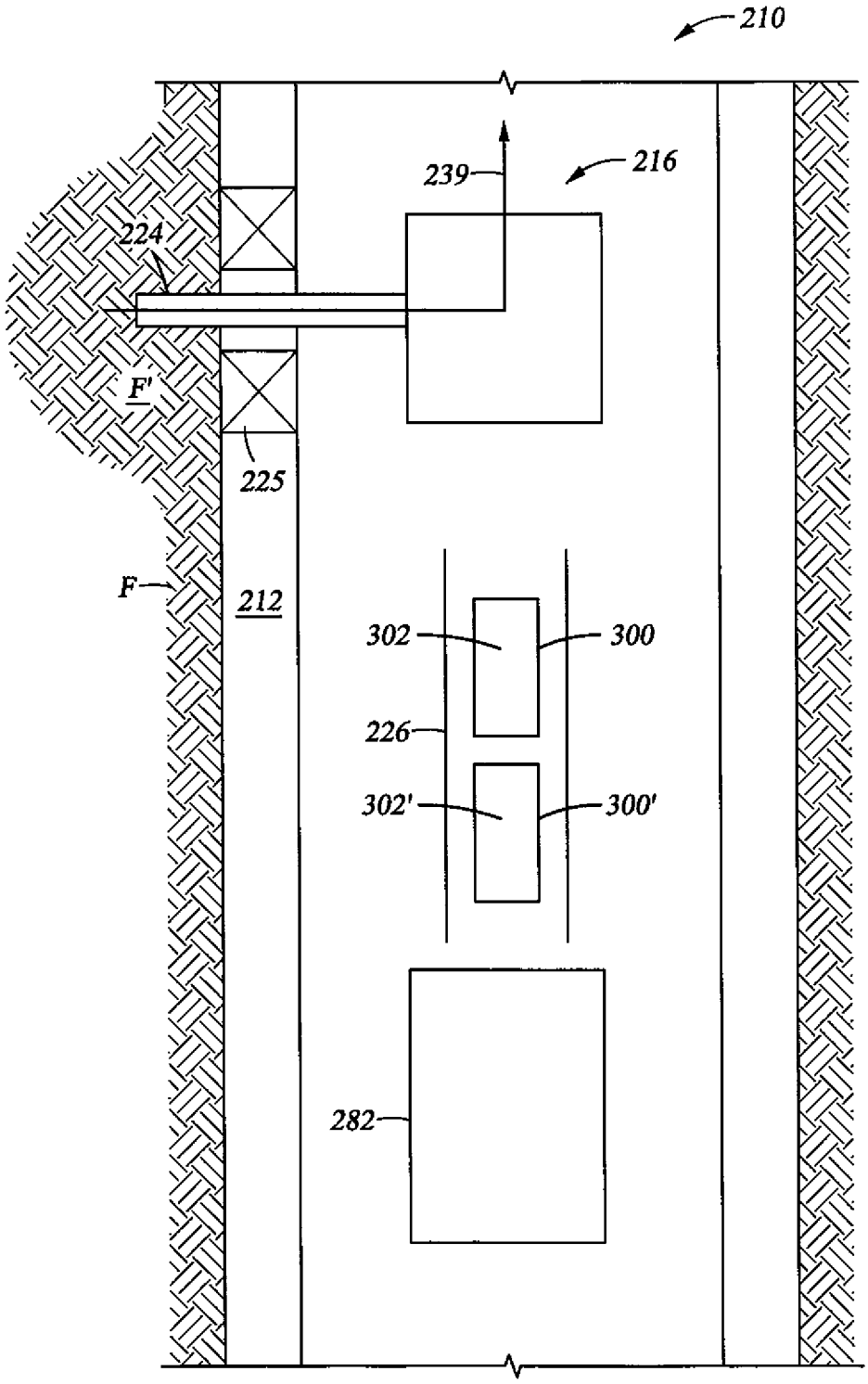
FIG. 3A is a high level schematic diagram of a downhole tool according to the disclosure, wherein cores may be flushed.

FIG. 3A shows a downhole tool 210 deployed in a wellbore 212 of a formation F. The tool is equipped with a coring module 216 which includes a coring bit 224 for extracting core samples from location F' in formation F. The coring module may be similar to the coring module 71 in FIG. 1. In the embodiment of FIG. 3A, the coring bit 224 is optionally surrounded by an annular packer or seal 225. The annular packer 225 establishes an exclusive fluid communication between a portion of the wellbore wall and internal components of the downhole tool 210. Thus, using the coring module 216, the hydrocarbon viscosity may be reduced by injecting a solvent into the formation at location F'. The injection fluid may be passed through a flowline 239 connected to a storage and/or processing module (similar to the fluid storage section 61 in FIG. 1). From the foregoing, those skilled in the art will appreciate that the coring module 216 can also be used to collect flowable fluid directly from the formation and pass that fluid via a flowline 239 or another flow line (not shown) to the storage and/or processing module.

Continuing with FIG. 3A, the coring bit 224 is preferably arranged to swivel from horizontal to vertical so that core holders (300, 300', described in more detail hereinafter) containing the cores (e.g. 302, 302') can be stored in a vertical storage rack 226 which is illustrated as being located below the coring module 216. The core holders 300 and 300' may later be stored in the storage vessel 282, similar to the storage section 41 of FIG. 1.

Figure 3B:
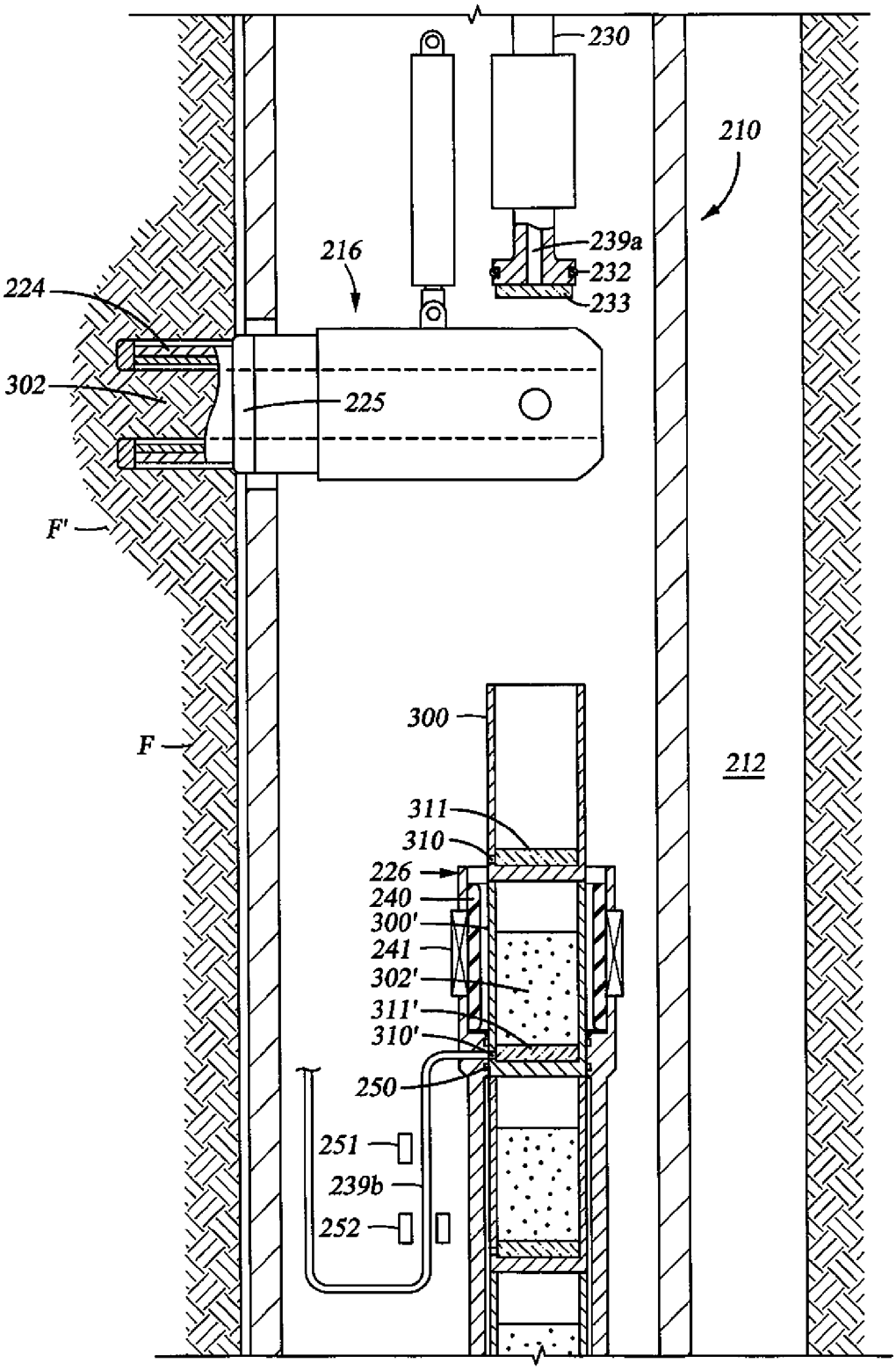
FIG. 3B is a detailed diagram of the downhole tool of FIG. 3A in a coring position.
Figure 3C:
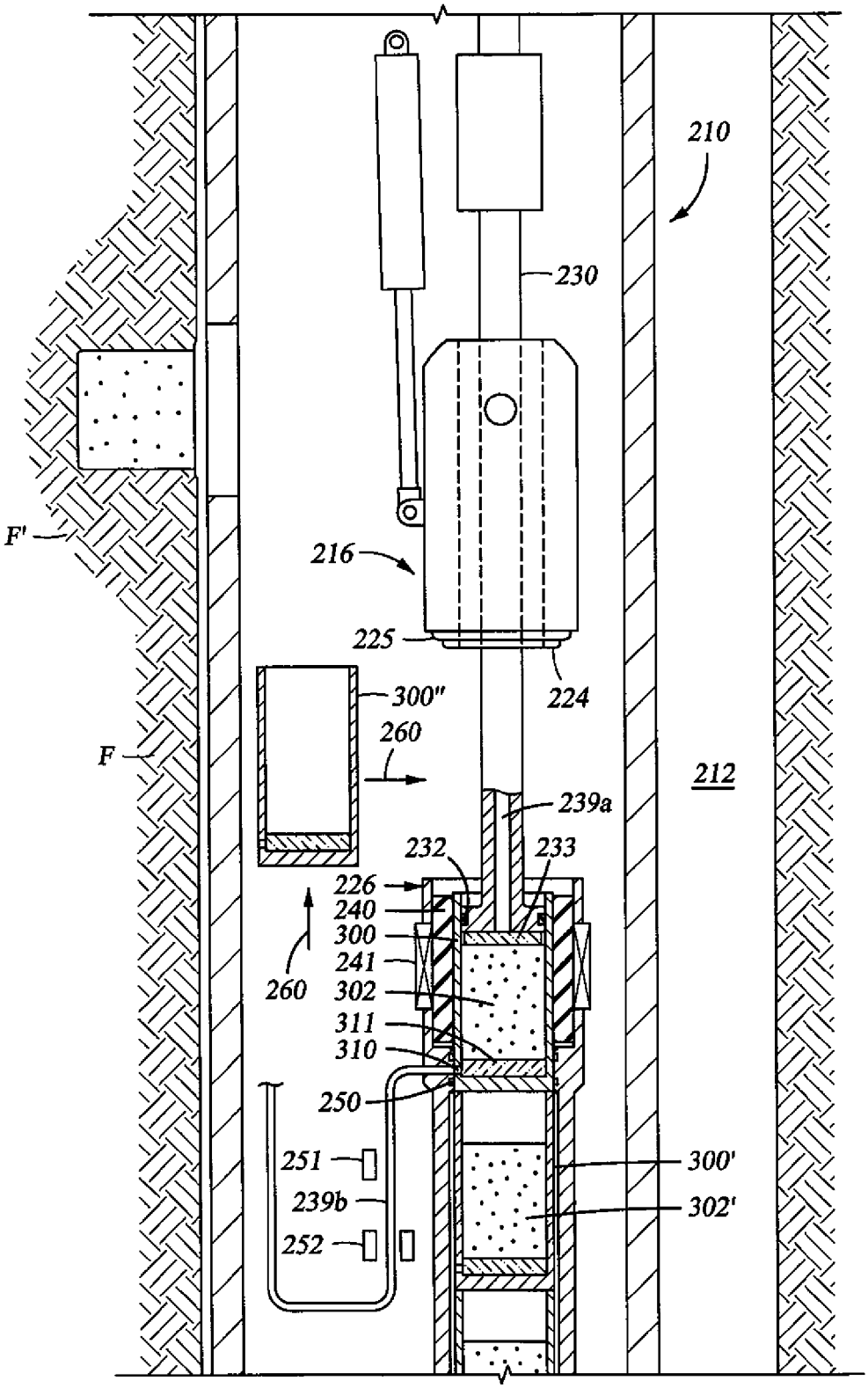
FIG. 3C is a detailed diagram of the downhole tool of FIG. 3A in an ejection position.

FIGS. 3B and 3C show the downhole tool 210 of FIG. 3A in more details. More specifically, FIGS. 3B and 3C show one implementation of the storage rack 226 and core holders 300, 300'. In this embodiment, the downhole tool is capable of flushing the captured cores, as explained below. For facilitating the flushing, the mobility of the fluid trapped in the pores of the captured core may be enhanced with various means, including providing heat and providing a solvent. The fluid extracted from the core may be stored in a downhole storage chamber and brought back at the surface for analysis. Alternatively, sensors, such has vibrating sensor 251, may provide the density and the viscosity of the flushed fluid at a plurality of temperatures. Moreover, the flushing operation may be controlled based on the measurements performed by a sensor, such as optical sensor 252, as further detailed below.

Turning to FIG. 3B, the downhole tool 210 is shown when the coring module 216 is in the coring position. The coring bit 224 is rotated and extended into the formation F, cutting thereby the core 302 about the location F' in the formation F. The coring operation continues until the core 302 has a sufficient length. Next, the core 302 is severed from the formation F. Note that while coring, the core holder 300 is secured in the downhole tool 210 with means not shown, and is disposed for receiving the core 302 when the core pusher 230 slides vertically through the coring module 216 and the core bit 224 (FIG. 3C). The core holder 300 is located on top of another core holder 300', containing another core 302', captured previously by the downhole tool 210.

Turning now to FIG. 3C, the downhole tool 210 is shown when the coring module 216 is in the ejection position with the core pusher 230 being in the extended position. The core pusher is used for ejecting the core 302 from the coring bit 224, and introducing the core 302 into the core holder 300. The core pusher 230 may further be used for displacing the core holder 300 downward, from a receiving position (FIG. 3B) to a testing position (FIG. 3C).

In this embodiment, the core pusher 230 is provided with a seal 232, such as an O-ring, disposed at a distal end of the core pusher. The seal 232 is adapted for sliding tightly into an opening of the core holders. Thus, the top of the core 302 may be hermetically isolated from the wellbore fluid as the distal end of the core pusher 230 is introduced into the core holder 300. The core pusher 230 is also provided with a flow line 239*a*, that may be in fluid communication with a fluid actuation device, such as a pump, and a fluid storage chamber. The fluid storage chamber may be filled at the surface with a flushing fluid, and may be used for conveying the flushing fluid downhole. The core pusher 230 may be provided with a porous layer 233, affixed to the distal end of the core pusher and proximate to an outlet of the flow line 239*a*. Thus, the flushing fluid may be passed through the flow line 239*a*, diffuse through the porous layer 233, and be injected into the core 302.

The core holder 300, 300' are each provided with at least one conduit 310, 310', disposed at a lower end of the core holder. The core holder 300, 300' may optionally include a porous layer 311, 311' respectively, affixed to the core holder and located proximate an inlet of the conduit 310, 310'. In the testing position (FIG. 3C), an outlet of the conduit 310 is located about a seal 250, such as an O-ring, disposed on the storage rack 226. The seal 250 establishes an exclusive fluid communication between an interior of the core holder 300 and a flow line 239*b* of the downhole tool 210. Thus, formation fluid trapped in the pores of the core 302 may flow through a porous layer 311, exit the core holder 300 through the conduit 310, and be collected by the downhole tool 210 via the flow line 239*b*. The collected fluid may be analyzed in situ with sensors 251 and/or 252 disposed on the flow line 239*b*. Alternatively or additionally, the collected fluid may be stored in a fluid storage chamber located in the downhole tool 210, and may be retrieved at the surface.

As shown in FIGS. 3B and 3C, a selectively extendable packer 240 is mounted in an interior of the storage rack 226. The extendable packer 240 may be a compression packer for example. The extendable packer 240 is shown in a retracted position in FIG. 3B and in an extended position in FIG. 3C. In the retracted position, the extendable packer is adapted for facilitating the downward displacement of the core holder 300. In the extended position, the packer 240 is adapted for applying a pressure on a lateral surface (preferably deformable) of the core holder 300. By applying a pressure on the lateral surface of the core holder, flushing fluid flow bypass around the core 302 may be reduced. In other words, flushing fluid may not easily flow between the flow line 239*a* and the conduit 310 without diffusing through the core 302. Thus, the flushing fluid migrates through the rock of the core 302, and pushes the formation fluid towards the flow line 239*b*.

In the case the core 302 contains a hydrocarbon with very low mobility, the downhole tool 210 may be provided with one or more mobility enhancement means. For example, the storage rack may include a heat source 241. The heat source is preferably well thermally coupled to the core 302. In another example, heat is provided by the flow line 239*a* in the form of a hot flushing fluid, such as hot water. Alternatively a heat source, such as a resistive coil, may be disposed at the distal end of the core pusher 230. In yet another example, the flushing fluid is a solvent that, when mixed with the core hydrocarbon, reduces its viscosity.

An optical sensor 252 may be provided on the flow line 239*b*. The optical sensor may be used to advantage for monitoring the flushing process, amongst other uses. The flushing fluid is preferably clear (colorless): examples of flushing fluid include water, toluene, dichloroethane, dichloromethane, etc. . . . A clear flushing fluid provides a strong optical contrast with oil, which is typically dark in color. This contrast makes the detection of the presence of flushing fluid in the flow line 239*b* possible. When flushing fluid is detected in sufficient quantity or concentration in the flow line 239*b*, the flushing operation may be terminated. It should be appreciated that the flushing fluid may not displace the hydrocarbon in a piston-like manner, so the first detection of flushing fluid does not necessarily mean all the hydrocarbon has been removed. Then, the first detection of flushing fluid does not trigger automatically the termination of the flushing operation. In addition, when the flushing fluid and the oil are not miscible, slugs of oil may be selectively routed to a fluid storage chamber. The termination of the flushing process may also be determined from the volume of flushing fluid introduced in the core holder. For example, the flushing operation may be terminated when the volume of the injected fluid is in excess of one fourth of the core volume.

A density and viscosity sensor 251 may also be provided for measuring the density and viscosity of the extracted fluid. Optionally, the sensor 251 is coupled to a temperature sensor (not shown separately) so that data points representing the extracted fluid viscosity as a function of temperature are made available, for example to a surface operator. These data may be used for heating and sampling the formation F with a conventional sampling tool.

When the flushing of the core 302 is finished, or as desired, the core pusher 230 is retracted back into the position shown in FIG. 3B. A new core holder 300", shown in FIG. 3C, is then made available for receiving a new core, as indicated by arrows 260. Operations may be repeated at the same depth of interest or at another depth, as depicted in FIG. 3B. If desired, the core may be stored. Alternatively, the core may be ground into pieces (e.g. together with its holder), using a grinder similar to the grinder 150 of FIG. 2B, and ejected into the wellbore.

It should be understood that FIGS. 2A-2B, 3A-3C are shown for illustration purposes. In particular, while a side-wall coring tool is depicted, fluid extraction can similarly be achieved with an in-line coring tool. For example, a portion of the core located in the core barrel may be flushed and the formation fluid captured into one or more fluid storage chambers and/or analyzed downhole. The flushing process may also be enhanced by delivering heat or solvent, for example, to the core located in the core barrel.

In addition, the invention is not limited to reservoirs having a hydrocarbon fluid with low or very low mobility, such as heavy oil, bitumen or oil shale reservoirs. For example, the disclosed methods and apparatuses may be used to advantage for evaluating any underground formation, and in particular formations where drilling fluid invasion does not preclude reservoir hydrocarbon in the captured cores. In this case, the hydrocarbon may be extracted or analyzed downhole from captured cores. Otherwise, the most mobile or volatile components of the reservoir hydrocarbon contained initially in the core may leave it as the core is brought up to surface, thus compromising a subsequent analysis of the reservoir hydrocarbon in a laboratory.

Further, the disclosure is not limited to extracting hydrocarbons by grinding or flushing a core. Other extraction mechanisms, such as lowering the pressure or increasing the temperature may be used, in particular for initiating a phase transition (vaporization) of a portion of the hydrocarbon trapped the core. Still further, the disclosure is not limited to the use of one particular solvent and/or the use of a particular mechanism for providing heat for increasing the mobility of hydrocarbon trapped in a core. Various solvents may be carried downhole, such as carbon dioxide, hydrogen, nitrogen, toluene, dichloroethane and delivered to the core, as needed. Heat may alternatively be generated downhole by an exothermic reaction, ultrasonic emitters, etc. . . .

According to another aspect of this disclosure, the tool 11 of FIG. 1 is capable of performing downhole tests on the core 23. For example, the tool 11 may be capable of measuring the dielectric constant of the core, as further described with respect to FIGS. 4 and 5. In one exemplary application, the tool 11 is utilized for evaluating a reservoir containing a hydrocarbon that may be heated with electro-magnetic waves in the radio or microwave range. The frequency of absorption may change significantly from a reservoir to another. The absorption of electro-magnetic waves may be inferred from the measurement of the dielectric constant at a plurality of frequencies. Thus, knowledge of the formation dielectric constant as a function of frequency would provide valuable insight as to the viability of heating strategies based on electro-magnetic radiations. Also, the tool 11 may be capable of measuring the thermal properties of the core, as further described with respect to FIG. 6. In another exemplary application, the tool 11 is utilized in a reservoir containing a hydrocarbon having a mobility that can be increased by heating the formation. These reservoirs usually have significant variation in thermal properties. Taking into account the finite heating power available, the thermal properties have a large impact on the speed at which a given volume of oil can be heated above a temperature threshold, e.g. large thermal diffusivity being favorable. Thus, knowledge of the thermal diffusivity of a formation, amongst other formation characteristics, would provide valuable insight as to the viability of heating strategies that might be utilized to mobilize hydrocarbon in the formation.

Figure 4:
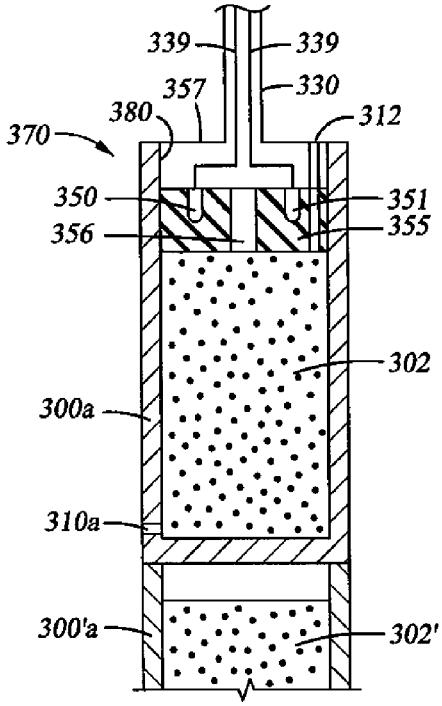
FIG. 4 is a schematic illustration of a portion of a downhole tool according to the disclosure, wherein the dielectric constant of cores may be measured.

In the embodiment of FIG. 4, a sensor capable of measuring the dielectric constant of a core is provided. The value of the dielectric constant provided by the sensor may be used, for example, to determine a frequency range suitable for heating the formation with electro-magnetic waves, as further detailed with respect to FIG. 5.

More specifically, FIG. 4 illustrates a portion of a core pusher 330 and core holders 300*a*, 300*a*' according to this disclosure. The core pusher 330 and the core holders 300*a*, 300'*a* may be used as part of the downhole tool 210. As shown in FIG. 4 the core holder 300*a* is stacked on top of a core holder 300'*a*, in a configuration shown in FIG. 3A. For example, the core holders 300*a* and 300'*a* may be disposed in a storage rack (not shown), similar to the storage rack 226 of FIG. 3A.

A distal end 370 of the core pusher 330 is adapted for ejecting a core 302 from a coring bit and engaging the core 302 into the core holder 300*a*, in a similar way as depicted in FIG. 3C. The distal end 370 comprises a conductive (e.g. metallic) cap 357, configured for electrical coupling with an opening 380 of the core holder 300*a*. The distal end 370 may further comprise one or more small conduit 312 for facilitating the expulsion of wellbore fluid as the distal end is introduced in the core holder. The distal end 370 of the core pusher 330 is provided with two antennae 350 and 351, e.g. semi circular loops, connected to electronics in the downhole tool via wires 339. The other side of the antennae is electrically coupled, e.g. welded, to the cap 357. The antennae are disposed around a conductive (e.g. metallic) core 356, and are embedded into a tore 355 having a low magnetic susceptibility. For example, the tore 355 may be made of plastic material. The conductive core 356 is made preferably flush with the tore 355.

The core holder 300*a* is adapted for receiving the core 302. The core holder 300*a* is further configured for providing, in combination with the cap 357, a conductive enclosure around the core 302 and the antennae 350, and 351. Thus, the core holder 300*a* is preferably made of conductive material (e.g. metal). Optionally, the core holder 300*a* may comprise one or more conduit 310*a* for evacuating the wellbore fluid as the core 302 is inserted into the core holder 300*a*.

In the embodiment of FIG. 4, it is apparent that the core holder 300*a* and the core pusher end 370 are configured as to behave like an electro-magnetic resonator. The cavity of the resonator includes the core 302, therefore, the core dielectric constant may determine at least in part the resonance frequencies of this resonator. Thus, the resonance frequencies of the resonator may be characterized and the core dielectric constants may be computed from the characterization. For example, a microwave vector analyzer is coupled to the antennae 350 and 351 via the wires 339, for measuring the complex transmission and reflection coefficients of the cavity, as a function of frequency. The microwave vector analyzer may be operated in the radio to microwave frequency range, in particular between approximately one kilohertz and approximately one gigahertz. A plurality of resonances are detected from the transmission and reflection coefficients. The resonance frequencies and their associated quality factors are related to an inductance characteristic L of the cavity and to two capacitance characteristics $C_1$ and $C_2$ of the cavity. The inductance characteristic L and the capacitance characteristic $C_1$ are related to the tore 355 and may be measured in a laboratory. The capacitance $C_2$ is related to the complex dielectric constant $\in$ of the core 302, and its length l. Thus, knowing the inductance characteristic L, the capacitance characteristics $C_1$ and the core length l, it possible to compute the complex permittivity of the core at the detected resonance frequencies, as represented in FIG. 5.

Figure 5:
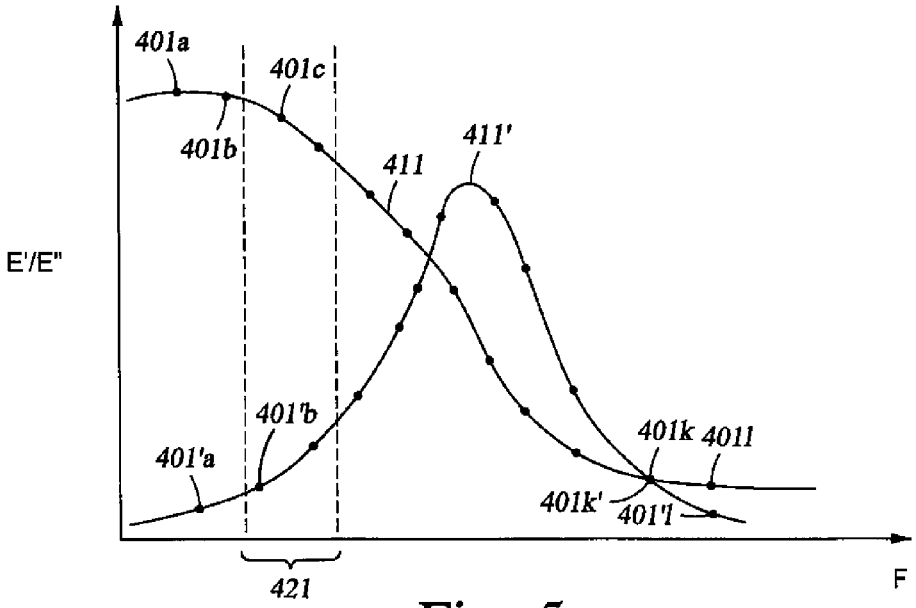
FIG. 5 is a graph representing the dielectric constant of a core as a function of frequency, as may be provided by a sensor in FIG. 4.

FIG. 5 shows a graph comprising the calculated value of the complex dielectric constant $\in$ of the core, as measured for example with the sensor of FIG. 4. The complex dielectric constant $\in$ comprises a real part $\in'$ and an imaginary part $\in''$ plotted along the y axis, as a function of frequency F plotted along the x axis. Using the sensor of FIG. 4, the real part of the dielectric constant of the core is computed at a plurality of resonance frequencies, and shown by numeral 401*a*, 401*b*, 401*c* . . . 401*k*, 401*l*. The imaginary part of the dielectric constant of the core is also computed, and shown by numeral 401'*a*, 401'*b* . . . 401'*k*, 401'*l*. These points define a first cure 411 and a second curve 411'. These curves may be used to determine a range 421, at which the formation (in which the core has been formed) efficiently propagates and absorbs electro-magnetic waves and converts the electro-magnetic energy into heat.

Hereafter it is assumed in this analysis that the captured core is representative of the formation surrounding the location from which the core has been taken. If that is not the case, corrections may be applied to the measurement on the core for better representing the formation characteristics. Preferably, the frequency range 421 is at a low frequency. At low frequencies, the electro-magnetic waves propagate deeper in the formation, and may thereby heat a larger volume of formation. However, the frequency range 421 should be at a high enough frequency so that the imaginary part of the dielectric constant (shown by the curve 411') has sufficient amplitude. At the frequencies where the imaginary part of the dielectric constant has high amplitude, the formation absorbs the electro-magnetic waves and converts them into heat.

In one example, the techniques described with respect to FIGS. 4 and 5 are used in a reservoir containing heavy oil. As well known in the art, heavy oils usually contain a significant portion of asphaltenes. Oils containing asphaltenes have a dielectric constant that varies significantly with many parameters, such as frequency, pressure and temperature. Thus, the dependency of the dielectric constant of heavy oil is generally unknown. This dependency can be measured in situ, preferably at the reservoir pressure and temperature, with the device shown in FIG. 4. The knowledge of the dependency of the dielectric constant as a function of frequency can be utilized in real time, for example for determining a frequency range at which the reservoir oil may transmit and absorbs electro-magnetic waves. Thus, an electro-magnetic tool (not shown), optionally part of the tool string 11, may be tuned accordingly for heating the formation F (FIG. 1). As the temperature of the formation increases, the mobility of the heavy oil also increases, and a conventional sampling tool may be used for capturing a sample of mobilized oil in a storage chamber and/or analyzing the formation oil in situ.

Those skilled in the art will appreciate that measurements of the dielectric constant of cores may be useful even if the fluid trapped in the core is not heavy oil. For example, a core may be flushed with various fluids downhole and the impact on the core dielectric constant may be computed. The results may be used to advantage in an earth formation model, for correlating oil saturations to electro-magnetic measurements. Alternatively or additionally, dielectric constant characteristics measured downhole may be used for evaluating production strategies involving electro-magnetic heating.

Figure 6:
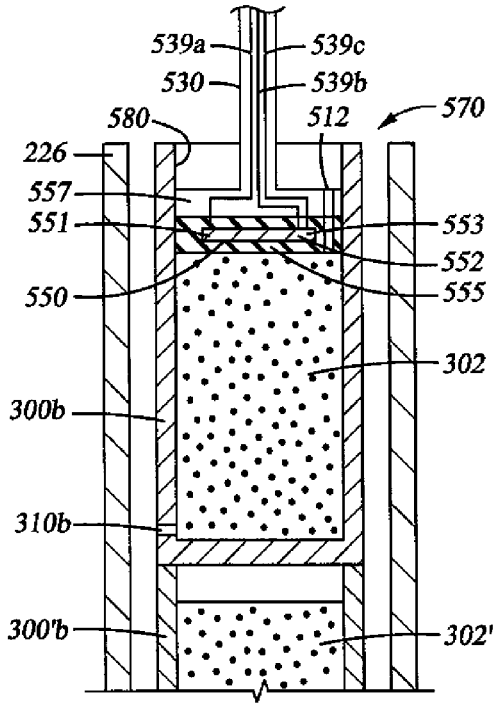
FIG. 6 is a schematic illustration of a portion of a downhole tool according to the disclosure, wherein the thermal diffusivity of cores may be measured.

Turning now to FIG. 6, an alternate embodiment of a sensor for measuring thermal characteristics of a core is disclosed. In the embodiment of FIG. 6, a sensor capable of measuring the thermal diffusivity and/or the volumetric heat capacity of the core is affixed to the core pusher 530. The value of the thermal diffusivity and/or the volumetric heat capacity provided by the sensor may be used, for example, to determine a thermal model of the formation. A thermal model of the formation may in turn be used for evaluating the performance of a heating tool coupled to the formation, the performance of a production scheme, etc.

FIG. 6 shows a portion of a core pusher 530 and core holders 300*b*, 300*b*', that may be used as part of the downhole tool 210 (FIG. 3A). The core holder 300*b* is adapted for receiving the core 302. The core holder 300*b* may be configured for providing a thermally insulated enclosure around the core 302. Alternatively, the storage rack 226 holding the core holder 300*b* and 300'*b* may be configured for providing a thermal insulation around a lateral surface of the core holder 300*b*. Optionally, the core holder 300*b* may comprise one or more conduit 310*b* for evacuating the wellbore fluid as the core 302 is inserted into the core holder 300*b*.

A distal end 570 of the core pusher is adapted for ejecting a core 302 from a coring bit and engaging the core 302 into the core holder 300*b* through an opening 580 of the core holder 300*b* (see FIG. 3C). The distal end 570 of the core pusher 530 is provided with a resistive wire 550, e.g. a platinum wire, embedded in a ceramic block 555. The resistive wire 550 is connected at three locations 551, 552 and 553, to electronics in the downhole tool via wires 539*a*, 539*b*, and 539*c* respectively. The distal end 570 also comprises a cap 557, preferably made of a material having a low thermal conductivity. The distal end 570 may further comprise one or more small conduit 512 for facilitating the expulsion of wellbore fluid as the distal end is introduced in the core holder.

In operation, the embodiment of FIG. 6 may be utilized as follows. In one example, a large electric current is controllably flowed through the wire 550 for a short duration, for example between locations 551 and 553. The current pulse may produce a transient heat source. Preferably, one of the core holder 300*b* and the storage rack 226 prevent heat diffusion across the lateral surface of the core holder 300*b*. Preferably again, the cap 557 prevents the diffusion of heat above the core 302. Thus, heat energy produced by the wire diffuses predominantly in the ceramic and in the core.

In one embodiment, the resistance of the wire 550 is correlated to its temperature, and a Wheatstone bridge may be used for measuring the resistance of the wire 550 after the current pulse has been generated. The resistance of the wire between location 551 and 552, $R_1(t)$, is measured at a plurality of time samples and recorded. Additionally, the resistance of the platinum wire between location 551 and 553, $R_2(t)$, may be measured at a plurality of time samples and recorded. The thermal diffusivity of the core $\kappa$, equal to the ratio of the thermal conductivity $\lambda$ by the volumetric heat capacity $C_p$ may be inferred from the measured values of $R_1(t)$ and $R_2(t)$ utilizing an inversion model. The inversion model may be determined by using Finite Element Analysis modeling, and/or using procedures similar to those described for the measurement of the thermal conductivity of a molten metal with a hot wire described in Int. J. Thermophys 2006, vol 27, pages 92-102. Also, the volumetric heat capacity $C_p$ may be inferred from the measured values of $R_1$ and $R_2$ after stabilization, and the calculated heat energy generated during the current pulse.

While methods using a thermally insulated (adiabatically enclosed) core in a container have been described, the volumetric heat capacity or thermal diffusivity may be measured even if heat losses out of the core are significant. However, it may be useful to take heat losses into account in the analysis. For example, heat losses may be calibrated in a controlled environment and the calibration may be used when interpreting downhole measurements. Also, while techniques using a transient heat source have been described, a steady state heat source may alternatively be used for determining the heat capacity and the thermal diffusivity. Further, instead of using the resistance of a platinum wire for measuring a temperature indicative of the temperature field in the core, one or more temperature sensor, distinct from a heat source, may be implemented. Still further, while techniques using two measurements of the wire resistivity are useful to minimize end-effects, that is, the finite length of the wire, from the interpretation, a single measurement of the wire resistivity may be sufficient.

The thermal diffusivity and volumetric heat capacity of the core is usually representative of the thermal diffusivity and volumetric heat capacity of the formation from which it has been extracted. The knowledge of the thermal diffusivity of the formation, amongst other characteristics, may be used to advantage for evaluating thermal production of the hydrocarbon contained in the formation F, such as production by steam injection, by resistive heating, etc. In particular, this knowledge may be useful for determining a method of heating the formation and sampling the formation fluid with a conventional sampling tool.

According to yet another aspect of this disclosure, the tool string 11 of FIG. 1 may further be configured for individually sealing each core sample in its own container. FIGS. 7, 8A, 8B, 9A, and 9B illustrate individually sealed core sample containers which are based on the core holders that may be provided by the tool string 11. The sealing methods described hereafter preserve the petrophysical characteristics of core samples taken from formations when the samples would otherwise undergo contamination by wellbore fluids while being brought to the surface. The sealing methods are also useful in situations where the seals prevent or minimize loss of the hydrocarbon trapped in the core samples.

Figure 7:
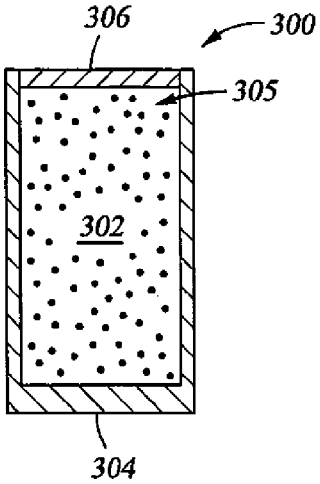
FIG. 7 is a schematic diagram of a core holder with a seal over its open end.

Turning now to FIG. 7, a cylindrical core holder 300 is illustrated in section. The core holder 300 surrounds a core sample 302 containing formation hydrocarbon trapped in the pores of the formation rock. The core holder 300 has a closed end 304 and the opposite end 305 is normally open to receive the core sample from the coring bit. According to this embodiment, after the core sample 302 is captured in the core holder 300, a seal cap 306 is applied to seal the open end 305. This effectively creates a sealed vessel. In some cases, one or more elastomeric cap 306 is provided in the downhole tool and may be inserted in the open end of the core holder. In other cases, a liquid resin or other polymer may be delivered at the top of the core by the downhole tool, using for example the flowline 239*a* shown in FIGS. 3B and 3C, and may be cured downhole. The sealed core holder 300 may then be placed in storage (e.g. 41 in FIG. 1).

Figure 8A:
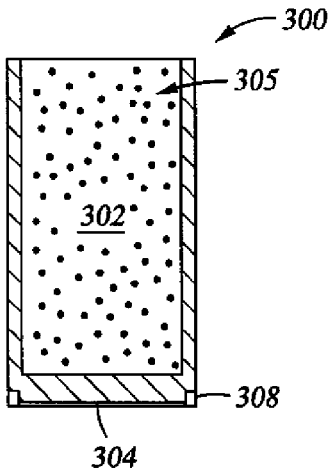
FIG. 8A is a schematic diagram of a core holder with a sealing ring for joining two core holders together.
Figure 8B:
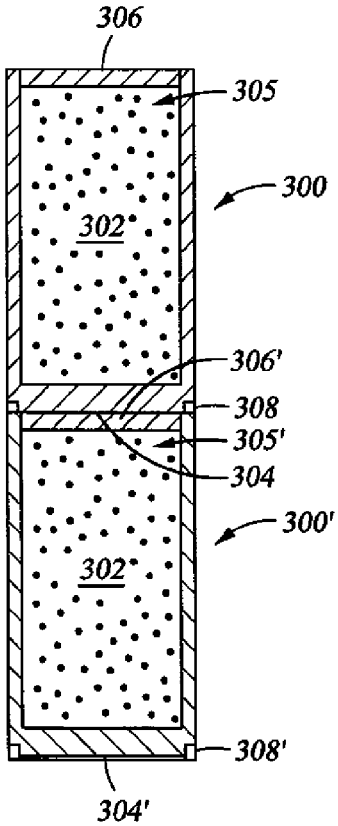
FIG. 8B is a schematic diagram of the core holder of FIG. 8A coupled to the sealed end of a second core holder.

Turning now to FIGS. 8A and 8B, according to this embodiment, an annular seal 308 is provided at the closed end 304 of the core holder 300 as shown in FIG. 8A. Referring back to FIG. 3A, it will be appreciated that the storage rack(s) 226 are arranged to stack core holders 300, 300', etc. end to end. Thus, when core holder 300 is stacked against core holder 300' as shown in FIG. 8B, the seal 308 of the core holder 300 is interposed between the closed end 304 of the holder 300 and the wall of the core holder 300' located near the open end 305' of the core holder 300'. The seal 308 may be formed from an elastomer and may be an O-ring. It will be noted from FIG. 8B that both core containers 300 and 300' are provided with seals 308, 308'. Many core holders can be stacked end to end in a storage rack. Optionally, one or more seal cap 306, 306' may be provided in addition to the annular seals 308, 308'.

Figure 9A:
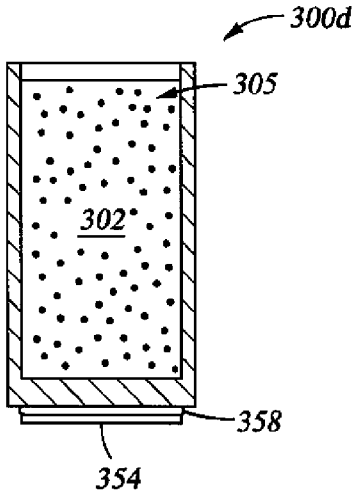
FIG. 9A is a schematic diagram of a core holder with interlocking structure at its closed end.
Figure 9B:
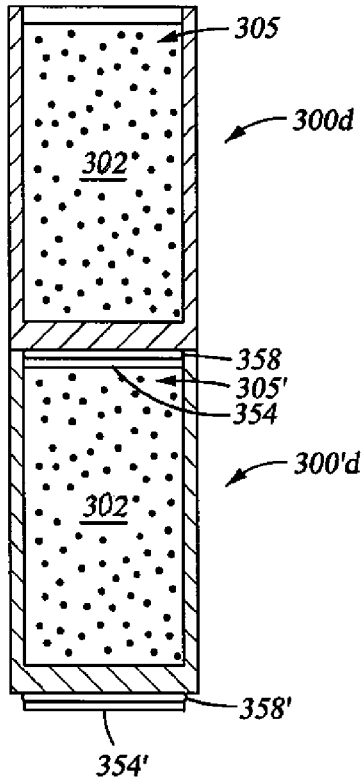
FIG. 9B is a schematic diagram of the core holder of FIG. 9A interlocked with a core holder of the same type.

FIGS. 9A and 9B show another embodiment for sealing individually a core in its own container. As shown in FIG. 9A, the closed end 354 of core holder 300*d* is machined to form an interlocking step which is dimensioned to mate with the open end 305' of another similarly configured core holder such as the core holder 300'*d* shown in FIG. 9B. The step 354 is also advantageously provided with an annular elastomeric seal (e.g. O-ring) 358 (358').

As illustrated in FIG. 9B, the step 354 with seal 358 of the core holder 300*d* interlocks with the open end 305' of the core holder 300'*d*. Optionally, the open end 305' (305) may also be provided with a seal, thereby providing a double seal between core holders. Those skilled in the art will appreciate that in this embodiment, the topmost core holder, e.g. 300*d* as shown in FIG. 9B, will be left with an open end 305. If desired, this situation may be remedied by sealing the open end 305 in the manner described above with reference to FIG. 7. Alternatively, a cap having a step like the steps 354 (354') may be provided to seal the open end 305 of the core holder 300.

Independently of the embodiment used to achieve individually sealed cores, storage for up to fifty core holders (each containing a 38 mm diameter by 100 mm long core) may be provided in the tool string 11. Those skilled in the art will appreciate that fifty cores of such dimension, assuming a formation porosity of 20%, will yield approximately 1.2 liters of formation hydrocarbon. This volume of fluid is usually sufficient for providing an analysis of the chemical structure of the fluid and/or representative values of fluid physical properties.

According to yet another aspect of the disclosure, core samples and/or fluid samples may be refrigerated via one or more refrigeration units. For example, cores of heavy oil, extra heavy oil or bitumen may be preserved by cooling the cores to approximately 0° C. and maintaining them at or below that temperature until they arrive at a surface facility. The cooling is intended to immobilize the liquid hydrocarbon by increasing its viscosity. The cooling temperature is not limited to 0° C. but may be adjusted based on the oil viscosity characteristics as a function of temperature. In another example, cores of methane hydrate may be preserved by cooling the cores to approximately −10° C. and maintaining them at or below that temperature. The cooling is intended to minimize phase transitions of the methane hydrate, e.g. methane sublimation. The temperature is not limited to −10° C. but may be adjusted based on the phase diagram of methane hydrate. In another example, the samples containing light oil or gases may be preserved by cooling the samples to approximately −185° C. and maintaining them at or below that temperature. The cooling is intended to decrease evaporation of potentially volatile components (such as methane, ethane, propane, etc.), by keeping them preferably in a phase less mobile than gas, that is liquid or solid. The temperature may be adjusted based on the (solid+liquid) and/or the (liquid+gas) phase transition temperatures of the sampled oil.

Figure 10A:
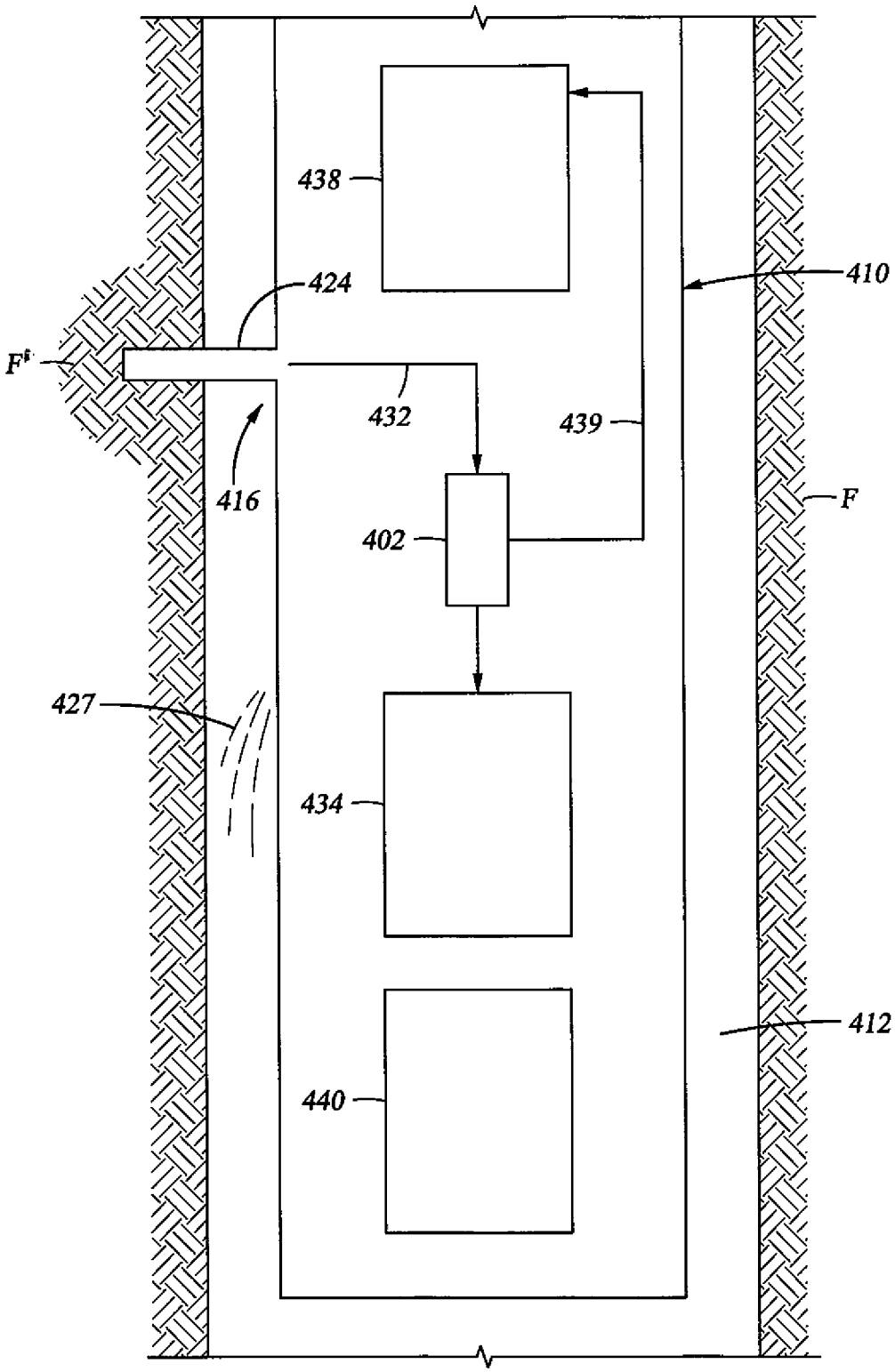
FIG. 10A is a high level schematic diagram of a downhole tool according to the disclosure which includes cooling means for preserving core samples.

FIG. 10A shows a tool 410 deployed in a wellbore 412 of a formation F containing heavy oil for example. The tool 410 is fitted with a coring module 416, similar to the coring module 71 in FIG. 1. The coring module 416 includes a coring bit 424, similar to the coring bit 21 in FIG. 1 to obtain cores from locations about F'. The cores 402 are retracted into the tool as shown schematically at 432 and placed in a core storage section 434. Alternatively, the cores may be processed to separate formation hydrocarbon from rock. In the latter case, the rock may be ground into pieces and ejected into the wellbore 412 as shown by 427. In the case where the hydrocarbon is separated from the rock, the hydrocarbon is transferred to fluid storage chamber 438 via a flowline 439. Core samples and/or fluid samples are refrigerated via one or more refrigeration units shown schematically as 440.

Figure 10B:
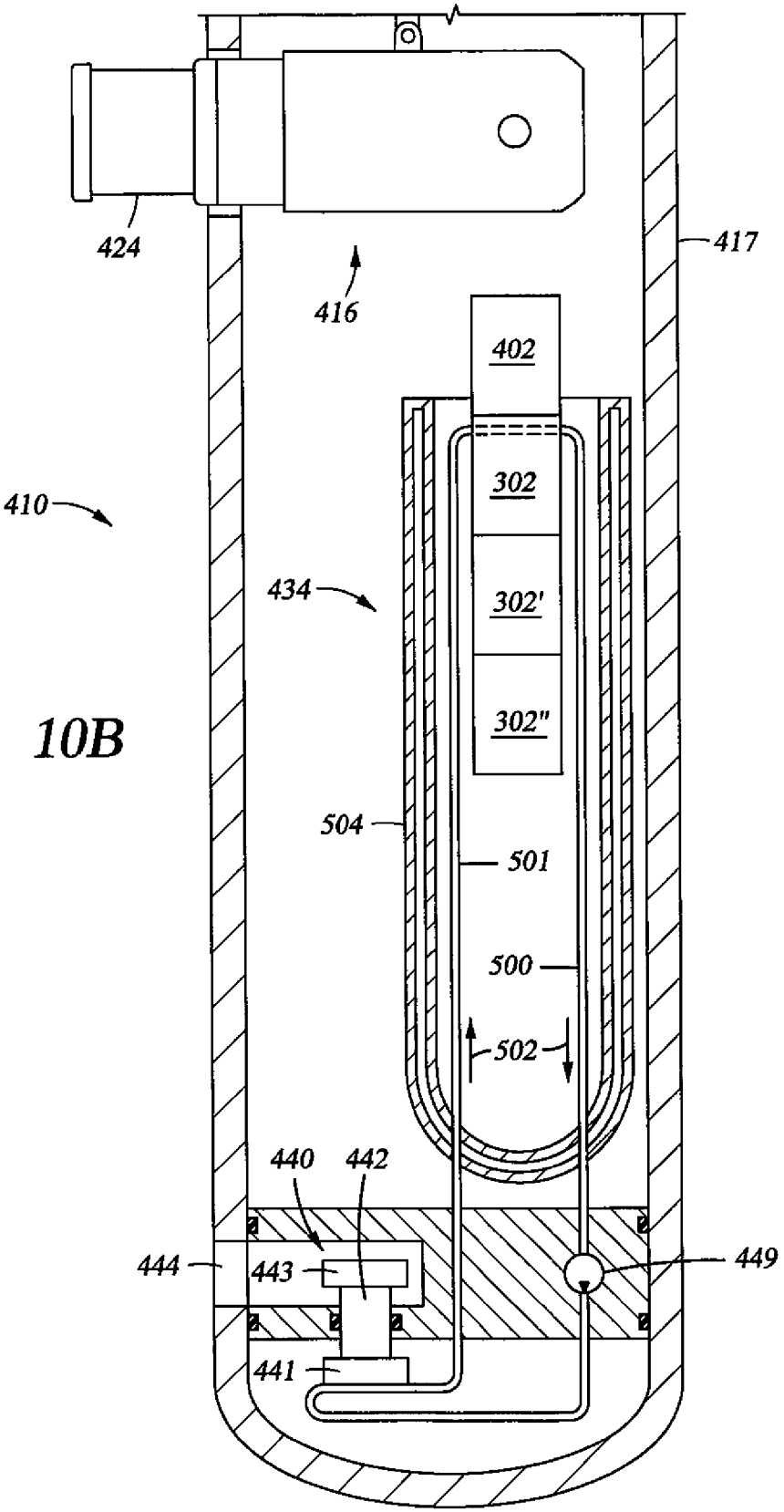
FIG. 10B is a detailed diagram of an implementation the downhole tool of FIG. 10A.

FIG. 10B shows one implementation of the tool 410 of FIG. 10A in more details. According to this embodiment, the rails upon which the core holders rest are cooled. Rails 500, 501 are disposed in the storage section 434 and utilized for holding a plurality of core, 302, 302', 302", etc. The cores may be provided with core holders such as depicted in FIGS. 7, 8A, 8B, 9A and 9B. The rails are fabricated to include a flowline (not shown) which runs through the rails. In the storage section, the rails are made of a material having a high thermal conductivity so that heat may be drawn from the cores. Coolant from a refrigeration system 440 is circulated through the rails 500, 501 with a pump 449, as indicated by arrows 502. Thus, the tool 410 is capable of cooling the cores. It should be appreciated that although two rails are depicted, any number of rails may be used. Furthermore, while the rails 500, 501 are depicted as straight rails, rails having for example a helical shape may also be used. Optionally, an insulating enclosure 504, such as a Dewar flask, may be provided in the storage section 434 for reducing the flux of heat towards the stored cored 300, 300', 300", etc. . . .

Continuing with FIG. 10B, the refrigeration system 440 comprises a heat pump 442 having a cold end 441 in thermal communication with the rails 500, 501. For example, a heat exchanger (not shown) may be disposed between the rails 500, 501 and the cold end of the heat pump 442. The heat pump 442 also comprises a hot end 443 that is in thermal communication with the wellbore fluid via one or more opening 444 in a housing 417 of the tool 410. Heat absorbed by the heat pump is dissipated in the wellbore fluid. Preferably, the heat pump 442 is implemented as a thermoacoustic cooling system such as that disclosed in previously incorporated [20.3041]. A thermoacoustic cooling system uses a loudspeaker to generate high acoustic pressure waves at a resonant frequency of a cavity to compress (and decompress) a refrigerant. When the refrigerant is decompressed by the loudspeaker, it cools down and moves toward the cold end. Conversely, when the refrigerant is compressed by the loudspeaker, it heats up and moves toward the hot end. When the refrigerant oscillates back and forth, heat is transferred from the cold end 441 of the heat pump 442 to the hot end 443 of the heat pump, optionally through a stack of thermally conductive plates disposed between the cold and hot ends of the heat pump. However, other kind of heat pump or heat sink may be used in the tool 410, including thermoelectric refrigerator, refrigerator functioning by isentropic gas expansion, heat pump or heat sinks based on enthalpy of phase transition, refrigerator utilizing a magneto-caloric effect, and the like. For example, the heat pump 442 may be implemented with a Stirling refrigeration system. Thus, while particular types of refrigerators have been disclosed, it will be understood other types of refrigeration apparatus may be used instead.

Figure 10C:
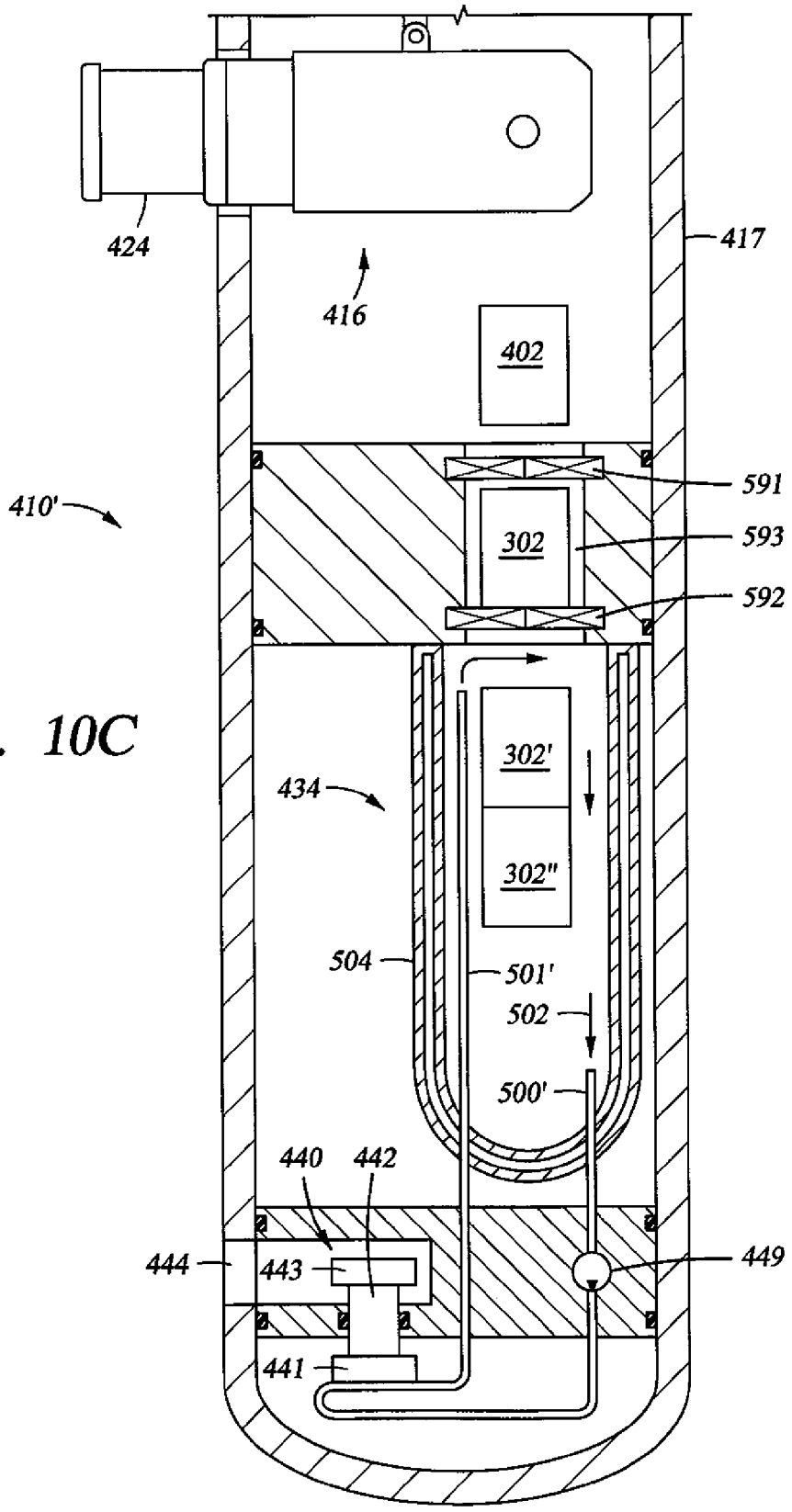
FIG. 10C is a detailed diagram of another implementation the downhole tool of FIG. 10A.

Turning now to FIG. 10C, another implementation of the tool 410 of FIG. 10A is shown into more details. In this example, the insulating enclosure 504 can be selectively sealed from the wellbore fluid with a fluid lock comprising valves 591 and 592. The valves 591 and 592 are sequentially operated as to introduce a captured core 432 successively in a lock chamber 593 (as illustrated for the core 300) and in the storage section 434 (as illustrated for the cores 300', 300"). The cooling fluid is circulated from an end of the cooling flowline 501', in the insulating enclosure 504 and around the cores, and then to one end of the cooling flow line 500', as indicated by the arrows 502. Thus the entire storage section 434, including the stored cores, may be maintained at a desired temperature.

In substitution to the two refrigeration methods detailed in FIGS. 10B and 10C, other refrigeration methods may alternatively be used. For example, each core holder (FIGS. 7-9B) can be fitted with a small refrigeration system such as a thermoelectric (Peltier Effect) refrigeration system. In this case, the core holder may include two dissimilar metals. A direct current may be coupled to the core holder, decreasing thereby the temperature at the metal junction and cooling the core.

Figure 11:
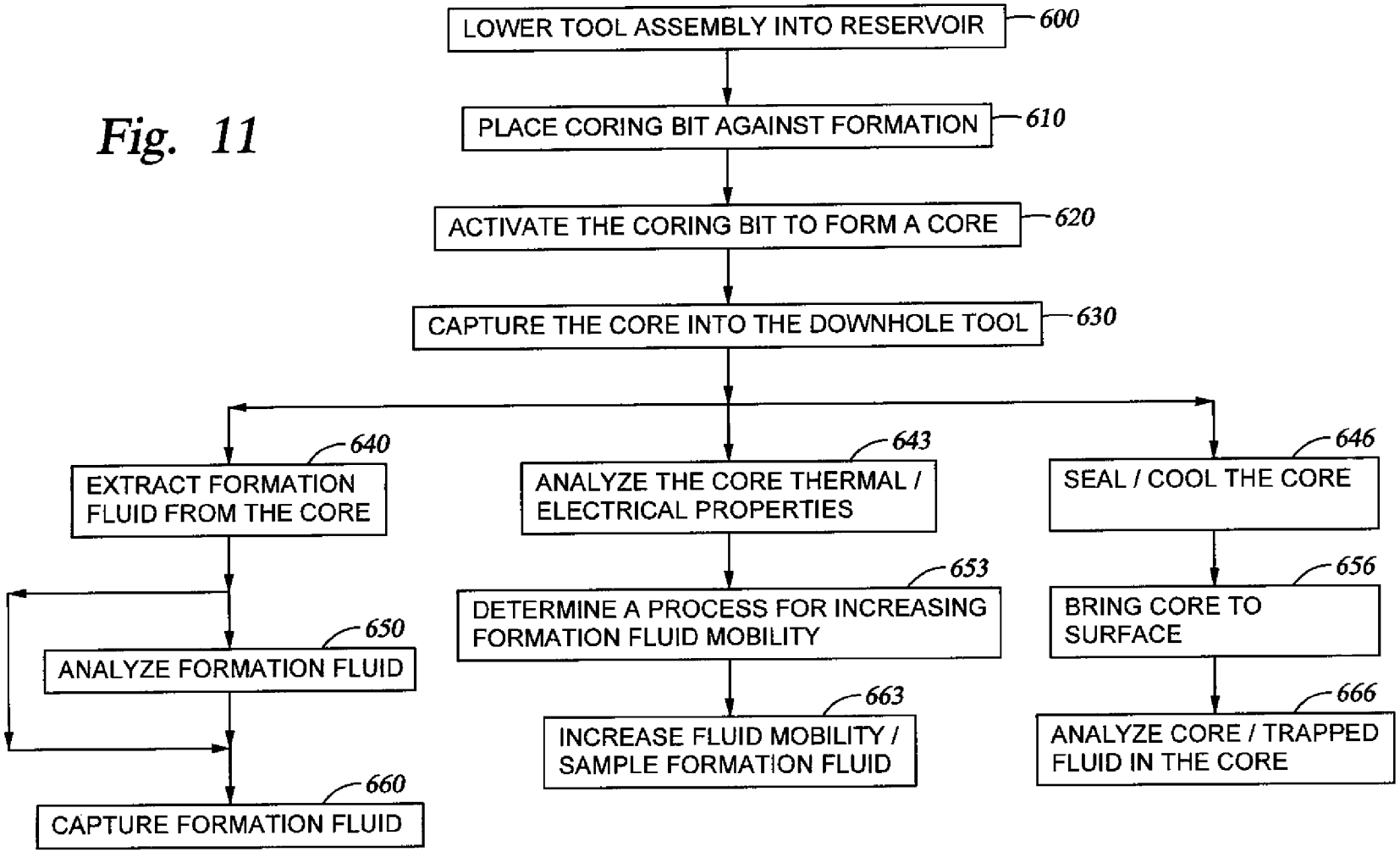
FIG. 11 is a high level flow chart illustrating a method of evaluating a reservoir containing hydrocarbon with a coring tool.

Turning now to FIG. 11, a method of evaluating a reservoir according to yet another aspect of this disclosure is illustrated via a simplified flow chart. Starting at 600, a tool assembly is lowered into the wellbore. The assembly may include one or more of the embodiments described above. The embodiments described above may be combined in any suitable way. For example, individually sealable core holder may be provided together with a refrigerating system, sensor for measuring core characteristics may be combined with devices for core flushing, and so on. Optionally, other tools such as conventional formation fluid sampling tools, heating tool, formation evaluation tools, etc, may be provided in the tool assembly. Furthermore, it will be understood that the tools of the disclosure may be additionally provided with functionalities known in the art that were not described here for the sake of clarity.

The coring tool is next located at a first selected depth at 610, which corresponds to a zone of potential interest. This selected depth may be the bottom of the wellbore in the case when an in-line coring tool is used. Usually, the reservoir at the selected depth contains a hydrocarbon of low mobility, such as heavy oil, extra heavy oil, bitumen, oil shale. However, some embodiments disclosed therein may be used to advantage in more conventional hydrocarbon reservoir, e.g. containing light oil. Thus, the coring tool could be useful in evaluating formations which contain hydrocarbons with a wide variety of viscosities. Also, the coring tool may be used in other hydrocarbon reservoirs such as methane hydrate reservoirs or coal bed methane reservoirs.

The coring tool is activated at 620 to obtain a core sample from the first zone of potential interest and the core sample is preferably captured in the tool at 630. The depth at which a core sample is obtained may be recorded, together with an identifier of the core sample. Typically, the core sample is introduced in a core holder. However, while specific structures have been disclosed for sealing samples in core holders, it will be recognized that other sealing apparatus might be appropriate. Also, the coring tool may not provide core holders, as well known in the art. The core sample may be tested to determine whether or not it is damaged (integrity tests). Integrity tests may include density measurements, or other measurement known in the art.

Next, the method may branch to one or more of the steps 640, 643, 646, and be repeated any number of times, as desired. For example, the core thermal or electrical properties may be measured (step 643), and the hydrocarbon may be extracted from the core (step 640). Optionally, the extracted hydrocarbon may be analyzed with a sensor disposed in the tool assembly. The core thermal or electrical properties may be measured again after the core has been flushed (step 643). It should be understood that other combinations are within the scope of this disclosure.

Referring now to step 640, the hydrocarbon may be extracted from the core, if desired. For example, the core may be flushed. The operation of step 640 may be repeated until a sufficient volume of fluid has been extracted. The remaining cores may be stored in the tool assembly, or discarded in the wellbore, e.g. ground and ejected from the tool. Also, the extraction or the analysis of the hydrocarbon in the core may be achieved by grinding the core as disclosed above.

Mobilizing the hydrocarbon trapped in the core may be necessary for flushing the core when the core has been formed in a methane hydrate reservoir or a heavy oil reservoir. Thus, the hydrocarbon extraction in step 640 may be assisted with heating. For example, heat may be provided to the core by irradiating the core with electro-magnetic waves in the radio or microwave range. Alternatively the core may be heated with a resistive element applied to a core surface. The core may also be submitted to ultrasonic waves capable of increasing its temperature by mechanical dissipation. Also, the core may be flushed with steam or a hot fluid, for example a hot fluid generated downhole by an exothermic reaction between two reactants conveyed in separated storage tanks in the tool assembly. These heating methods may be applied individually or in combination for mobilizing the hydrocarbon trapped in the core.

In addition or in substitution to heat, a solvent conveyed in the tool assembly may be provided for assisting the extraction of the hydrocarbon from the core at step 640. In some cases a solvent may be used for extracting heavy oil or bitumen from the cores. As known in the art, bitumen and extra heavy oil usually contain significant quantities of asphaltenes which constitute the highest molar mass of the oil. Asphaltenes comprise polar molecules and are soluble in aromatic solvents but not in alkane solvents. Thus to prevent asphaltene precipitation, the solvent is preferably a polar solvent or an aromatic solvent.

Referring now to step 650, the formation fluid may be analyzed. In particular, the viscosity may be measured downhole at various temperatures. This information may be of importance for evaluating a thermal recovery process for the reservoir. In some cases, this information may be used for sampling the reservoir using a heater and a conventional sampling tool disposed in the same tool assembly as the coring tool. Next, the analyzed fluid may be dumped in the wellbore or preserved in a fluid storage tank (step 660) disposed in the tool assembly for further analysis at the earth surface.

Turning now to step 660, the fluid may be stored in a fluid tank in the tool assembly. When the fluid is extracted with a solvent or with a fluid not miscible with the hydrocarbon, the solvent and the hydrocarbon may be separated downhole. The solvent may be recycled in the tool assembly for consecutive operations. The hydrocarbon may be stored in a separate container. Preferably, the fluid stored in a storage tank is kept in single phase, using methods known in the art or using refrigerator systems disclosed therein.

If desired the method of FIG. 11 may include tests of the core sample's electrical and/or thermal properties at step 643. Electrical property tests may include determining the dielectric constant at one or more frequencies. Thermal property tests may include tests for thermal diffusivity, e.g. hot wire tests as disclosed therein.

Referring now to step 653, one or more of the electrical properties measured at step 643, the thermal properties measured at step 643, and the fluid properties (e.g. viscosity as a function of temperature) measured at step 650, may be used in a formation model for determining if the fluid may be recovered by a heating process. In particular, the energy, the time or the power required for mobilizing the oil in a given volume of formation may be estimated. Temperature profiles in the formation may further be estimated and the maximum temperature may be compared to the temperature at which irreversible change may occur in the formation fluid (e.g. oil cracking). Thus, the viability of large scale production scheme or the feasibility of a conventional sampling assisted with heat delivered to the formation may be estimated. In particular, it may be determined if the tool assembly command enough power for mobilizing a sufficient volume of hydrocarbon. Also, it may be determined if the heating process may lead to sampled hydrocarbon whose chemical composition is not representative of the hydrocarbon in the reservoir, e.g. if thermal cracking has occurred prior to sampling. At step 663, a sampling operation determined at least in part from the analysis of the recovery process detailed above may be performed with tools conveyed in the same tool assembly as the coring tool or otherwise.

If desired the method of FIG. 11 may include preserving the core at step 646. Preserving the core may be achieved with refrigerating the core, sealing the core or a combination of sealing and refrigerating. Other preservation methods may be used in addition to the preservation methods described above. For example, a buffer fluid may be provided between the core and the core holder, usually prior to sealing the core holder. Examples of buffer fluids include gels, cements, and polymers. Thus, the reservoir fluids trapped in the pores of the cores at the time the core was formed may remain in the core as the core is brought back to the earth surface.

At step 656, the cores are brought to the earth surface. In some cases, temperature sensors are used to monitor a temperature in storage sections of the tool assembly and may sense the temperature of the core or the fluid samples. The temperature may be used for controlling the heat pump and/or the refrigerant fluid pump conveyed in the tool assembly, for example to achieve a desired temperature as the samples are retrieved from the wellbore.

At step 666, the core and/or the fluid disposed therein may be analysed to determine one or more properties of the formation and/or the formation fluid.

In any case, if more samples are desired, the assembly is moved to another depth and the process repeats for another zone of potential interest. At some point all of the desired samples will have been obtained. After all of the samples have been obtained, the assembly will be brought up to the surface. Captured fluids and/or cores may be analyzed at the well site, or packaged, preserved, and transported to a laboratory for other analysis. An analysis report or log may be provided, including a wellbore identification, the depth at which the samples were captured and corresponding physical properties of the samples measured downhole and/or uphole.

There have been described and illustrated herein several embodiments of methods and apparatus for obtaining representative downhole samples of heavy oil and/or bitumen. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as claimed.

What is claimed is:

1. A method for evaluating an underground formation, comprising:

obtaining a core sample from the formation via a coring tool disposed within a downhole tool;

actuating a core pusher to transfer the core sample to a core holder; and measuring, via engagement of the core pusher with the core holder, at least one of a dielectric constant of the core sample at a plurality of frequencies, a thermal diffusivity of the core sample, or a heat capacity of the core sample, wherein measuring comprises propagating electro-magnetic waves through the core sample via antennae disposed in the core pusher.

2. The method of claim 1 further comprising determining a frequency range for operation of a radiant heater based on the measured at least one of a dielectric constant of the core sample at a plurality of frequencies, a thermal diffusivity of the core sample, or a heat capacity of the core sample.

3. The method of claim 2 further comprising heating the formation using the radiant heater and the frequency range.

4. The method of claim 1 further comprising determining a parameter that corresponds to a heating process of the formation based on the measured at least one of a dielectric constant of the core sample at a plurality of frequencies, a thermal diffusivity of the core sample, or a heat capacity of the core sample.

5. The method of claim 1, wherein measuring comprises measuring the dielectric constant of the core sample at a plurality of frequencies.

6. The method of claim 1, wherein actuating a core pusher comprises transferring the core sample from a coring bit of the coring tool to the core holder, wherein the measuring is performed while the core sample is disposed within the core holder.

7. The method of claim 1, wherein obtaining a core sample comprises operating a coring bit and wherein actuating a core pusher comprises extending the core pusher through the coring bit to move the core sample from the coring bit to the core holder.

8. The method of claim 1 further comprising extending a distal end of the core pusher into an opening of the core holder to engage the core pusher with the core holder.

9. The method of claim 1, wherein the distal end of the core pusher comprises a conductive cap electrically coupled to the core holder, and wherein the antennae are electrically coupled to the cap and disposed around a conductive core extending through the cap.

10. A method for evaluating an underground formation, comprising:

obtaining a core sample from the formation via a coring tool disposed within a downhole tool;

actuating a core pusher to transfer the core sample to a core holder; and measuring, via engagement of the core pusher with the core holder, at least one of a dielectric constant of the core sample at a plurality of frequencies, a thermal diffusivity of the core sample, or a heat capacity of the core sample, wherein measuring comprises flowing electric current through a resistive wire disposed in the core pusher.

11. The method of claim 10 further comprising determining a parameter that corresponds to a heating process of the formation based on the measured at least one of a dielectric constant of the core sample at a plurality of frequencies, a thermal diffusivity of the core sample, or a heat capacity of the core sample.

12. The method of claim 10, wherein measuring comprises measuring the thermal diffusivity of the core sample.

13. The method of claim 10, wherein measuring comprises measuring the heat capacity of the core sample.

14. The method of claim 10, wherein actuating a core pusher comprises transferring the core sample from a coring bit of the coring tool to the core holder, wherein the measuring is performed while the core sample is disposed within the core holder.

15. The method of claim 10, wherein obtaining a core sample comprises operating a coring bit and wherein actuating a core pusher comprises extending the core pusher through the coring bit to move the core sample from the coring bit to the core holder.

16. The method of claim 10 further comprising extending a distal end of the core pusher into an opening of the core holder to engage the core pusher with the core holder.

17. The method of claim 10 wherein the distal end of the core pusher comprises a cap disposed in contact with thermally insulated walls of the core holder, and wherein the resistive wire is disposed in a block extending between the cap and the core sample.

* * * * *